US005670292A

United States Patent [19]

Matsumoto et al.

[11] Patent Number: 5,670,292

[45] Date of Patent: Sep. 23, 1997

[54] DRY TYPE IMAGE FORMATION PROCESS

[75] Inventors: Kazuhiko Matsumoto; Masaki Noro; Hisashi Okamura; Shun-ichi Ishikawa, all of Kanagawa, Japan

[73] Assignee: Fuji Photo Film Co., Ltd., Kanagawa, Japan

[21] Appl. No.: 522,091

[22] Filed: Aug. 31, 1995

[30] Foreign Application Priority Data

| | | | |
|---|---|---|---|
| Aug. 31, 1994 | [JP] | Japan | 6-206331 |
| Sep. 12, 1994 | [JP] | Japan | 6-217237 |

[51] Int. Cl.[6] ..... G03C 1/498; G03C 8/40

[52] U.S. Cl. ..... 430/138; 430/337; 430/349; 430/352; 430/353

[58] Field of Search ..... 430/138, 337, 430/349, 352, 353

[56] References Cited

U.S. PATENT DOCUMENTS

| | | | |
|---|---|---|---|
| 4,283,477 | 8/1981 | Fletcher et al. | 430/141 |
| 4,500,624 | 2/1985 | Aono et al. | 430/138 |
| 4,500,626 | 2/1985 | Naito et al. . | |
| 4,675,277 | 6/1987 | Sato et al. . | |
| 4,678,739 | 7/1987 | Kitaguchi et al. . | |

FOREIGN PATENT DOCUMENTS

| | | | |
|---|---|---|---|
| 0588325 | 3/1994 | European Pat. Off. . | |
| 62-288836 | 12/1987 | Japan | G03C 7/00 |
| 62-288837 | 12/1987 | Japan | G03C 7/00 |
| 62-299847 | 12/1987 | Japan | G03C 7/00 |
| 1-173036 | 7/1989 | Japan | G03C 7/00 |
| 1-36932 B2 | 8/1989 | Japan | G03C 7/00 |

*Primary Examiner*—Mark F. Huff

*Attorney, Agent, or Firm*—Sughrue, Mion, Zinn, Macpeak & Seas

[57] ABSTRACT

A dry type image formation process which comprises imagewise exposing a heat-developable photosensitive material to light, and then heat-developing the heat-developable photosensitive material, wherein the heat-developable photosensitive material further comprises a component isolated by microcapsules and the heat-developable photosensitive material is pressed before or after heat development so that the microcapsules are ruptured to release the internal phase and cause the component to be diffused into the photosensitive layer, allowing its function to be fulfilled, and an image formation process which comprises heat-developing a heat-developable photosensitive material after or simultaneously with imagewise exposing, the heat-developable photosensitive material comprising a photosensitive silver halide, a reducing agent, a basic precursor, a dye-providing substance which undergoes heat development to release or produce a dye, and a silver halide fixing agent which is a compound capable of fixing and stabilizing the silver halide, which comprises isolating the silver halide fixing agent from the silver halide before heat-developing so as not to affect the silver halide and bring the silver halide fixing agent in contact with the silver halide after or simultaneously with heat-developing to fix undeveloped silver halide.

8 Claims, No Drawings

DRY TYPE IMAGE FORMATION PROCESS

FIELD OF THE INVENTION

The present invention relates to a dry type image formation process which forms an image by heat development and a heat-developable photographic material for use in the process.

BACKGROUND OF THE INVENTION

The silver halide system photography is superior to other photographic processes such as electrophotography and diazo process in photographic characteristics such as sensitivity and gradation adjustment and thus has heretofore been most widely used. However, this process employs a so-called wet process comprising development, stopping, fixing, rinsing, drying, etc. and thus requires much time and labor. A dry process, which is simpler than the wet process has been thus desired.

As compared with electrophotography and diazo photography, heat development photography using silver halide is excellent in photographic properties such as sensitivity and gradation and has heretofore found wide application. Heat-developable photographic photosensitive materials employing heat treatment have been developed and proposed. For details, reference can be made to "Shashin Kogaku no Kiso (Basis of Photographic Engineering)", Edition for non-silver salt photography, Corona, 1982, pp. 242–255, U.S. Pat. No. 4,500,626, JP-B-43-4921 (The term "JP-B" as used herein means an "examined Japanese patent publication"), and JP-B-43-4924. Representative examples of commercially available heat-developable photographic photosensitive materials include "Drysilver" (available from 3M).

Further, a process has been known which comprises the heat development with a coloring material to obtain a color image (black-and-white or color). For example, a process which comprises the combination of an oxidation product of a developing agent and a coupler to form a color image is disclosed in U.S. Pat. Nos. 3,531,286, 3,761,270, and 4,021,240, Belgian Patent 802,519 and Research Disclosure, September 1975, pp. 31–32.

Such a heat-developable photographic photosensitive material comprises various components which take part in the development and post-treatment of silver halide besides the components which directly take part in the formation of an image (silver halide or coloring material). Examples of the components which fulfill its function during the image formation include those which accelerate the development of silver halide, and those which accelerate the formation of a color image. Examples of the components which fulfill its function after the image formation include those which stops development, those which inhibits print-out of silver halide, and those which fixes silver halide.

In the case where these components are provided on the same support, it is necessary that these components be isolated from the other components until when they should fulfill its function so that no undesirable effects can be exerted during storage and image formation. Examples of the method for isolating these components from the other components include a method which comprises the solid dispersion of these components, a method which comprises the protection of these components with an oil, a method which comprises the incorporation of these components separately from the other components, a method which comprises the isolation of these components by an interlayer, and a method which comprises the use of these components in the form of precursor. A method for attaining better isolation is to contain these components in microcapsules. For example, an oil-containing microcapsule is disclosed in JP-B-1-36932. A base- or base precursor-containing microcapsule is disclosed in JP-A-62-288836 (The term "JP-A" as used herein means an "unexamined published Japanese patent application"). An acid- or acid precursor-containing microcapsule is disclosed in JP-A-62-288837. A development inhibitor-containing microcapsule is disclosed in JP-A-62-299847. A hydrophilic thermal solvent-containing microcapsule is disclosed in JP-A-1-173036.

It is said that any of these microcapsules releases its inner phase when acted on by heat during heat development. However, the inventors' study shows that if such a method is used, the components which fulfill its function are released during heat development, lessening the effect of the components which should fulfill its function during the image formation. It was also found that if such a method is used, the components which should fulfill its function after the image formation can adverse effects on the image formation.

Further, a silver halide photosensitive material is liable to discoloration of developed image under ordinary light or density rise on the undeveloped area.

The image deterioration is mainly attributed to the remaining of photosensitive undeveloped silver halide in the photographic photosensitive material. In order to inhibit this trouble, an approach has been proposed which comprises the stabilization of the processed photographic photosensitive material with a film or solution containing a fixing agent. This approach is disclosed in known references such as JP-A-50-54329 and JP-A-1-161343.

On the other hand, the use of a fixing as an image stabilizer on the same support in a heat-developable and heat-stabilizable photographic photosensitive material is disclosed in U.S. Pat. No. 4,012,260, JP-A-57-150842, and JP-A-57-154173. These techniques comprise the effective use of such a compound in a silver halide photosensitive material, making it possible to provide a light-insensitive silver (I) complex after exposure and processing. Such a complex can render the developed image contained in the processed silver halide photosensitive material fast to light.

U.S. Pat. No. 4,283,477 discloses an example of the use of a coloring material and a fixing agent on the same support.

It has been known that a photographic photosensitive material employing a dye-providing compound to form an image comprises an alkali precursor to attain both the expedition of image formation and the preservability of the photographic photosensitive material. However, a heat-developable silver halide photosensitive material which uses an alkali precursor and a dye-providing compound to form an image is liable to a remarkable enlargement of color image after processing. Thus, no systems satisfying image stability have been known.

SUMMARY OF THE INVENTION

It is therefore an object of the present invention to provide a heat development image formation process which comprises isolating components which take part in the development or post-treatment of silver halide until when they should fulfill its function, and then releasing these components from the isolation shortly before it is necessary for them to fulfill its function so that they can thoroughly fulfill its function.

It is another object of the present invention to provide a heat development image formation photographic photosensitive material (hereinafter referred to as a heat-developable photosensitive material or a photosensitive material) which can provide a stable processed image that shows no density rise on the background and no image density rise even after stored in daylight.

These and other objects of the present invention will become more apparent from the following detailed description and examples.

The foregoing objects of the present invention can also be accomplished by a dry process for the formation of an image which comprises imagewise exposing a heat-developable photosensitive material comprising a support provided thereon a photosensitive layer which comprises at least a silver halide, a binder and a reducing agent, to light, and then heat-developing the heat-developable photosensitive material to obtain an image, wherein the heat-developable photosensitive material further comprises a component isolated by microcapsules and the heat-developable photosensitive material is pressed before or after heat development so that the microcapsules are ruptured to release the internal phase and cause the component to be diffused into the photosensitive layer, allowing its function to be fulfilled.

In accordance with the present invention, the heat-developable photosensitive material can be pressed before heat development so that a component which should fulfill its function during image formation such as a development accelerator and a dye image formation accelerator is released from microcapsules and then diffused into the photosensitive layer to thoroughly fulfill its function. It has been further found that the heat-developable photosensitive material can be pressed after heat development so that a component which should fulfill its function after image formation such as a development stopping agent, a silver halide print-out inhibitor and a silver halide fixing agent is released from microcapsules and then diffused into the photosensitive layer to fulfill its function without having adverse effects on image formation.

The foregoing objects of the present invention can be further accomplished by an image formation process which comprises heat-developing a heat-developable photosensitive material after or simultaneously with imagewise exposing, the heat-developable photosensitive material comprising a support having provided thereon a photosensitive silver halide, a reducing agent, a basic precursor, a dye-providing substance which undergoes heat development to release or produce a dye, and a compound capable of fixing and stabilizing the silver halide (silver halide fixing agent), which comprises isolating the silver halide fixing agent from the silver halide before heat-developing so as not to affect the silver halide and bring the silver halide fixing agent in contact with the silver halide after or simultaneously with heat-developing to fix the silver halide.

DETAILED DESCRIPTION OF THE INVENTION

The silver halide for the photosensitive silver halide emulsion to be used in the present invention may be any of silver chloride, silver bromide, silver bromoiodide, silver bromochloride, silver chloroiodide and silver bromochloroiodide.

The silver halide emulsion to be used in the present invention may be a surface latent image type emulsion or an internal latent image type emulsion. The internal latent image type emulsion may be used as a direct reversal emulsion when combined with a nucleating agent or light fogging agent. The silver halide emulsion to be used in the present invention may be a so-called core-shell emulsion which comprises grains with core and shell having different phases from each other. Alternatively, silver halides having different compositions may be connected to each other via epitaxial junction. The silver halide emulsion may be monodisperse or polydisperse. As described in JP-A-1-167743 and JP-A-4-223463, monodisperse silver halide emulsions may be used in admixture to control gradation. The grain size of silver halide grains is preferably in the range of 0.1 to 2 μm, particularly 0.2 to 1.5 μm. The crystal habit of silver halide grains may be a regular crystal form such as cube, octahedron or tetradecahedron, an irregular crystal form such as sphere or plate having a high aspect ratio, a crystal form having crystal defect such as twinning plane, a composite thereof, and any other crystal form.

Specifically, any of silver halide emulsions prepared by the method as disclosed in U.S. Pat. Nos. 4,500,626 (50th column), and 4,628,021, Research Disclosure (hereinafter referred to as "RD") Nos. 17029 (1978), 17643 (December 1978), pp. 22–23, 18716 (November 1979), page 648, 307105 (November 1989), pp. 863–865, JP-A-62-253159, JP-A-64-13546, JP-A-2-236546, JP-A-3-110555, P. Glafkides, "Chemie et Phisique Photographique", Paul Montel, 1967, G. F. Duffin, "Photographic Emulsion Chemistry", Focal Press, 1966, and V. L. Zelikman et al., "Making and Coating Photographic Emulsion", Focal Press, 1964 may be used.

During the preparation of the photosensitive silver halide emulsion of the present invention, a so-called desalting process for removing excess salts is preferably effected. The desalting process may be accomplished by a noodle washing process which comprises gelation of gelatin or a sedimentation process utilizing an inorganic salt of polyvalent anions (e.g., sodium sulfate), anionic surface active agent, anionic polymer (e.g., sodium polystyrenesulfonate) or gelatin derivative (e.g., aliphatically acylated gelatin, aromatically acylated gelatin, aromatically carbamoylated gelatin). The sedimentation process is preferably used.

The photosensitive silver halide emulsion to be used in the present invention may comprise a heavy metal such as iridium, rhodium, platinum, cadmium, zinc, thallium, lead, iron, osmium and chromium incorporated therein for various purposes. These compounds may be used singly or in combination. These compounds may be used in the form of salt such as chloride, bromide and cyanide as well as various complexes. The added amount of such a compound depends on the purpose and normally falls within the range of from $10^{-9}$ to $10^{-3}$ mol per mol of silver halide. Such a compound may be uniformly incorporated in the silver halide gains or may be localized in the inside or on the surface of the silver halide grains. Specifically, emulsions as disclosed in JP-A-2-236542, JP-A-1-116637, and Japanese Patent Application No. 4-126629 are preferred.

In the process of the grain formation for the photosensitive silver halide emulsion of the present invention, as a silver halide solvent there may be used a thiocyanate, ammonia, 4-substituted thioether compound, organic thioether derivative as disclosed in JP-B-47-11386 or sulfur-containing compound as disclosed in JP-A-53-144319.

For the other conditions, reference can be made to P. Glafkides, "Chimie et Physique Photographique", Paul Montel, 1967, G. F. Duffin, "Photographic Emulsion Chemistry", Focal Press, 1966, V. L. Zelikman et al., "Making and Coating Photographic Emulsion", Focal Press, 1964, etc. In some detail, the emulsion can be prepared by any of the acid process, the neutral process, the ammonia process, etc. The reaction between a soluble silver salt and a soluble halogen salt can be carried out by any of a single jet process, a double jet process, a combination thereof, and the like. The double jet process is preferably used to obtain a monodisperse emulsion.

A method in which grains are formed in the presence of excess silver ions may be used. Further, a so-called controlled double jet process, in which a pAg value of a liquid phase in which silver halide grains are formed is maintained constant, may also be used as one of double jet process.

In order to expedite the growth of grains, the concentration and amount of the silver salt and halogen salt to be added and the rate at which these salts are added may be raised as disclosed in JP-A-55-142329, JP-A-55-158124, and U.S. Pat. No. 3,650,757.

The agitation of the reaction solution may be accomplished by any known method. The temperature and pH of the reaction solution during the formation of silver halide grains may be predetermined to any values depending on the purpose. The preferred pH range is from 2.2 to 8.5, more preferably from 2.5to 7.5.

The photosensitive silver halide emulsion is normally a chemically sensitized silver halide emulsion. The chemical sensitization of the photosensitive silver halide emulsion of the present invention can be accomplished by chalcogen sensitization process such as sulfur sensitization process, selenium sensitization process and tellurium sensitization process, noble metal sensitization process such as gold sensitization process, platinum sensitization process and palladium sensitization process, and reduction sensitization process, which are known for emulsion for ordinary photosensitive material, singly or in combination (as disclosed in JP-A-3-110555, JP-A-5-241267). These chemical sensitization processes can be effected in the presence of a nitrogen-containing heterocyclic compound (as disclosed in JP-A-62-253159). Further, a fog inhibitor as described later may be added to the emulsion which has thus been chemically sensitized. For details, reference can be made to JP-A-5-45833 and JP-A-62-40446.

The pH value of the emulsion during the chemical sensitization is preferably from 5.3 to 10.5, more preferably from 5.5 to 8.5. The pAg value of the emulsion during the chemical sensitization is preferably from 6.0 to 10.5, more preferably from 6.8 to 9.0.

The coated amount of the photosensitive silver halide emulsion to be used in the present invention is from 1 mg/m$^2$ to 10 g/m$^2$ in terms of silver.

In order to render the photosensitive silver halide emulsion green-sensitive, red-sensitive or infrared-sensitive, the photosensitive silver halide emulsion can be spectrally sensitized with methine dyes or other dyes. If necessary, a blue-sensitive emulsion may be spectrally sensitized to blue range.

Examples of dyes to be used in the spectral sensitization include cyanine dye, melocyanine dye, composite cyanine dye, composite melocyanine dye, holopolar cyanine dye, hemicyanine dye, styryl dye and hemioxonol dye.

Specifically, sensitizing dyes as disclosed in U.S. Patent 4,617,257, JP-A-59-180550, JP-A-64-13546, JP-A-5-45828, and JP-A-5-45834 can be used.

These sensitizing dyes can be used singly or in combination. A combination of these sensitizing dyes is often used particularly for the purpose of wavelength adjustment in supersensitization or spectral sensitization.

Besides these sensitizing dyes, a dye which does not exert a spectral sensitizing effect itself or a compound which does not substantially absorb visible light but exerts a supersensitizing effect may be incorporated in the emulsion (as disclosed in U.S. Pat. No. 3,615,641, and JP-A-63-23145).

The time at which these sensitizing dyes are incorporated in the emulsion may be during or before or after the chemical ripening or may be before or after the nucleation of silver halide grains as disclosed in U.S. Pat. Nos. 4,183,756, and 4,225,666. These sensitizing dyes or supersensitizers may be added in the form of solution in an organic solvent such as methanol, dispersion in gelatin or solution containing a surface active agent therein. The amount of these sensitizing dyes to be added is normally in the range of $10^{-8}$ mole to $10^{-2}$ mole per mole of silver halide.

Additives which can be used in these processes and known photographic additives which can be used in the heat-developable photosensitive material according to the present invention are also described in the above cited RD Nos. 17643, 18716 and 307105 as tabulated below.

| Kind of additive | RD17643 | RD18716 | RD307105 |
|---|---|---|---|
| 1. Chemical sensitizer | p. 23 | p. 648 right column (RC) | p. 866 |
| 2. Sensitivity increasing agent | | p. 648 RC | |
| 3. Spectral sensitizer and supersensitizer | pp. 23–24 | p. 648 RC–p. 649 RC | pp. 866–868 |
| 4. Brightening agent | p. 24 | p. 648 RC | p. 868 |
| 5. Antifoggant and stabilizer | pp. 24–25 | p. 649 RC | pp. 868–870 |
| 6. Light absorbent, filter dye, and ultraviolet absorbent | pp. 25–26 | p. 649 RC–p. 650 left column (LC) | p. 873 |
| 7. Dye image stabilizer | p. 25 | p. 650 LC | p. 872 |
| 8. Hardening agent | p. 26 | p. 651 LC | pp. 874–875 |
| 9. Binder | p. 26 | p. 650 LC | pp. 873–874 |
| 10. Plasticizer and lubricant | p. 27 | p. 650 RC | p. 876 |
| 11. Coating aid and surface active agent | pp. 26–27 | p. 650 RC | pp. 875–876 |
| 12. Antistatic agent | p. 27 | p. 650 RC | pp. 876–877 |
| 13. Matting agent | | | pp. 878–879 |

In the present invention, an organic metal salt as an oxidizing agent may be used in combination with the photosensitive silver halide emulsion. Particularly preferred among these organic metal salts are organic silver salts.

Examples of organic compounds which can be used to form such an organic silver salt as an oxidizing agent include benzotriazoles and aliphatic acids as disclosed in U.S. Pat. No. 4,500,626, 52nd column to 53rd column, and other compounds. Other useful examples of organic compounds include silver acetylene as described in U.S. Pat. No. 4,775,613. Two or more of these organic silver salts may be used in combination.

The organic silver salt can be used generally in an amount of 0.01 to 10 mole, preferably 0.01 to 1 mole per mole of the photosensitive silver halide. The sum of the coated amount of the photosensitive silver halide and organic silver salt is preferably in the range of 0.05 to 10 g/m$^2$, more preferably 0.1 to 4 g/m$^2$ as calculated in terms of silver.

As the binder to be contained in the layers constituting the heat-developable photosensitive material there may be preferably used a hydrophilic binder. Examples of the layers constituting the heat-developable photosensitive material (photographic constituting layers) include a protective layer, an interlayer, an undercoating layer, antihalation layer and a backing layer. Examples of such a hydrophilic binder include those described in JP-A-64-13546, pp. 71–75. Specifically, a transparent or semitransparent hydrophilic binder is preferred. Examples of such a transparent or semitransparent hydrophilic binder include proteins such as gelatin and gelatin derivative, natural compounds such as cellulose derivative, starch, gum arabic, dextran, pullulan and other polysaccharides, and synthetic high molecular compounds such as polyvinyl alcohol, polyvinyl pyrrolidone and acrylamide. Further, a highly hygroscopic polymer as disclosed in U.S. Pat. No. 4,960,681 and JP-A-62-245260, i.e., homopolymer of vinyl monomer having —COOM or —$SO_3M$ (in which M is a hydrogen atom or alkaline metal atom) or copolymer of such vinyl monomers or copolymer of such vinyl monomers with other vinyl monomers (e.g., sodium methacrylate, ammonium methacrylate, Sumikagel L-5H available from Sumitomo Chemical Co., Ltd.) may be used. Two or more of these binders may be used in combination. In particular, a combination of gelatin and the foregoing binder is preferred. Gelatin may be selected from lime-treated gelatin, acid-treated gelatin and so-called delimed gelatin having a reduced content of calcium or the like depending on various purposes. These gelatins may be used in combination.

As the reducing agent to be used in the present invention there can be used one known in the field of heat-developable photosensitive material. Dye providing compounds having reducing property as described later can also be used (in this case, other reducing agents can be used in combination there with). Further, a reducer precursor which exhibits no reducing effect itself but exerts a reducing effect when acted upon by a nucleophilic reagent or heat during development can be used.

Examples of reducing agents which can be used in the present invention include reducing agents and reducer precursors as disclosed in U.S. Pat. Nos. 4,500,626 (49th column–50th column), 4,839,272, 4,330,617, 4,590,152, 5,017,454, and 5,139,919, JP-A-60-140335, pp. 17–18, JP-A-57-40245, JP-A-56-138736, JP-A-59-178458, JP-A-59-53831, JP-A-59-182449, JP-A-59-182450, JP-A-60-119555, JP-A-60-128436, JP-A-60-128439, JP-A-60-198540, JP-A-60-181742, JP-A-61-259253, JP-A-62-201434, JP-A-62-244044, JP-A-62-131253, JP-A-62-131256, JP-A-63-10151, JP-A-64-13546, pp. 40–57, JP-A-1-120553, JP-A-2-32338, JP-A-2-35451, JP-A-2-234158, JP-A-3-160443, and EP 220,746, pp. 78–96. If a coupler is used as a dye-providing substance, one which serves as a color developing agent, particularly a paraphenylenediamine or paraaminophenol is preferably used among the foregoing reducing agents or precursors thereof.

A combination of various reducing agents as disclosed in U.S. Pat. No. 3,039,869 can be used.

In the case where a nondiffusible reducing agent is used, an electron transfer agent and/or electron transfer agent precursor can be optionally used in combination therewith to accelerate the migration of electrons between the nondiffusible reducing agent and the developable silver halide. In particular, those disclosed in the above cited U.S. Pat. No. 5,139,919, EP 418,743, JP-A-1-138556, and JP-A-3-102345 may be preferably used. Further, a method may be preferably used which comprises the stable incorporation of such a reducing agent in the layer as disclosed in JP-A-2-230143 and JP-A-2-235044.

Such an electron transfer agent or precursor thereof can be selected from the above mentioned reducing agents or precursors thereof. The electron transfer agent or precursor thereof preferably exhibits a greater mobility than the nondiffusible reducing agent (electron donor). Particularly useful electron transfer agents are 1-phenyl-3-pyrazolidones, sulfonamidephenols or aminophenols.

As the nondiffusible reducing agent (electron donor) to be used in combination with the electron transfer agent there can be selected any compounds which substantially do not migrate in the layers constituting photosensitive material from the above mentioned reducing agents. Preferred examples of such nondiffusible reducing agents include hydroquinones, sulfonamidephenols, sulfonamidenaphthols, hydrazines, hydrazones, compounds described as electron donors in JP-A-53-110827, U.S. Pat. Nos. 5,032,487, 5,026,634, and 4,839,272, and dye-providing compounds having reducing property and being nondiffusible as described later.

Electron-providing precursors as disclosed in JP-A-3-160443 may be preferably used.

In the present invention, the total amount of the reducing agent to be incorporated is preferably in the range of 0.01 to 20 mol, particularly 0.1 to 10 mol per mol of silver.

In the present invention, silver can be used as an image-forming substance. Alternatively, a compound which produces or releases a dye in correspondence or counter correspondence to the reaction of the reduction of silver ion to silver at a high temperature, i.e., dye providing compound may be incorporated in the system.

A dye may be transferred to provide an image formed only by dye. Alternatively, the dye may form an image with a developed silver produced during heat development.

Examples of the dye-providing compound employable in the present invention include leuco dyes which undergo reduction reaction to form dyes. Specific examples of such leuco dyes include those disclosed in U.S. Pat. Nos. 4,368,247, 4,374,921, 4,883,747, and 4,923,792.

Specific examples of the dye-providing compound having reducing property are also disclosed in JP-B-6-10729.

In particular, when the image formation process of the present invention is applied to printing film for PS plate in the printing field, a system may be preferably used in which a silver image is used in combination with a leuco dye or coupling dye (e.g., yellow coupler) which exhibits absorption at a wavelength of 400 to 450 nm where a gallium lamp (metal halide lamp), which is widely used as exposing light source, shows luminous bright lines, in order to exert a high shielding effect.

Examples of dye providing compounds which can be used in the present invention include compounds (couplers) which undergo oxidative coupling reaction to form a dye. These couplers may be two-equivalent or four-equivalent. Further, two-equivalent couplers containing a nondiffusible group as a releasing group which undergo oxidative coupling reaction to form a diffusible dye can be preferably used. These nondiffusible groups may form a polymer chain. Specific examples of color developing agents and couplers are further described in T. H. James, "The Theory of the Photographic Process", 4th ed., pp. 291–334 and pp. 354–361, RD-307105, page 871, and JP-A-58-123533, JP-A-58-149046, JP-A-58-149047, JP-A-59-111148, JP-A-59-124399,JP-A-59-174835, JP-A-59-231539, JP-A-59-231540, JP-A-60-2950, JP-A-60-2951, JP-A-60-14242, JP-A-60-23474, and JP-A-60-66249.

The incorporation of a hydrophobic additive such as dye providing compound and nondiffusible reducing agent in the layers constituting the photosensitive material can be accomplished by any known method as disclosed in U.S. Pat. No. 2,322,027. In this case, a high boiling organic solvent as disclosed in U.S. Pat. Nos. 4,555,470, 4,536,466, 4,536,467, 4,587,206, 4,555,476, and 4,599,296, and JP-B-3-62256 can be used in combination with a low boiling organic solvent having a boiling point as low as 50° C. to 160° C. as necessary. These dye-providing compounds, nondiffusive reducing agents and high boiling organic solvents may be used in combination.

The amount of the high boiling organic solvent to be used is generally in the range of 10 g or less, preferably 5 g or less, more preferably from 0.1 g to 1 g per g of dye providing compound and generally in the range of 1 ml or less, preferably 0.5 ml or less, more preferably 0.3 ml or less per g of binder used.

Alternatively, a dispersion process with a polymer as described in JP-B-51-39853, and JP-A-51-59943 or a process as disclosed in JP-A-62-30242 which comprises the incorporation in the form of fine dispersion can be used.

A compound substantially insoluble in water can be finely dispersed in the binder rather than using the above mentioned methods.

When a hydrophobic compound is dispersed in a hydrophilic colloid, various surface active agents can be used. For example, compounds disclosed as surface active agents in JP-A-59-157636, pp. 37–38, or compounds as described as surface active agents in the above cited RD's can be used.

The heat-developable photosensitive material of the present invention may comprise a compound which not only activates development but also stabilizes an image. Specific examples of such compounds which can be preferably used are described in U.S. Pat. No. 4,500,626, 51st column to 52nd column.

The image formation accelerator, development stopping agent, silver halide print-out inhibitor and silver halide fixing agent as examples of the components contained in the microcapsules of the present invention will be further described hereinafter.

Such an image formation accelerator serves to accelerate the redox reaction of a silver salt oxidizing agent and a reducing agent or accelerate reaction such as production or decomposition of a dye from a dye providing substance and release of a diffusible dye from a dye providing substance. From the standpoint of physicochemical function, the image formation accelerator can be classified as base or base precursor, nucleophilic compound, high boiling organic solvent (oil), thermal solvent, surface active agent, compound interacting with silver or silver ion, etc. However, these substance groups normally have composite functions and exert some of these accelerating effects in combination. These image formation accelerators are further described in U.S. Pat. No. 4,678,739, 38th column–40th column.

Preferred examples of the base precursor employable in the present invention include salt of an organic acid which undergoes decarboxylation on heating with a base, compound which undergoes decomposition by reaction such as intramolecular nucleophilic substitution reaction, Lossen rearrangement and Beckmann rearrangement to release amines, compound which undergoes some reaction on heating to release a base, and compound which undergoes electrolysis or complexing reaction to produce a base. Examples of the foregoing base precursor which produces a base on heating include trichloroacetates as disclosed in British Patent 998,959. Examples of such base precursors having an enhanced stability include α-sulfonylacetates as disclosed in U.S. Pat. No. 4,060,420, propiolacetates as disclosed in JP-A-59-180537, 2-carboxycarboamide derivatives as disclosed in U.S. Pat. No. 4,088,496, salt of thermally decomposable acid with an organic base as well as alkaline metal or alkaline earth metal as a base (JP-A-59-195237), hydroxamcarbamates utilizing Lossen rearrangement as disclosed in JP-A-59-168440, and aldoximecarbamates which produce nitrile on heating as disclosed in JP-A-59-157637.

Base precursors as disclosed in British Patens 998,945 and 2,079,480, JP-A-50-226225, U.S. Pat. Nos. 3,220,846, 4,514,493, and 4,657,848, and Kochi Gijutsu (Known Technique) No. 5, Aztech, Mar. 22, 1991, pp. 55–86, are also useful.

The added amount of the image formation accelerator is preferably from 0.1 to 20 g/m$^2$, more preferably from 1 to 10 g/m$^2$.

In the present invention, the heat-developable photosensitive material may comprise various development stopping agents for the purpose of obtaining an invariably constant image quality against the fluctuation of processing temperature and time during development and enhancing the image preservability.

The development stopping agent is a compound which rapidly neutralizes or reacts with a base after a proper development to reduce the base concentration in the film to stop development or a compound which interacts with silver or a silver salt after a proper development to inhibit development. Specific examples of such a development stopping agent include an acid precursor which releases an acid on attacking by acid or under heating, an electrophilic compound which undergoes substitution reaction with a base present therewith under heating, a nitrogen-containing heterocyclic compound, and a mercapto compound and precursor thereof. These compounds are further described in JP-A-62-253159, pp. 31–32.

For details, reference can be made to the above cited Kochi Gijtsu No. 5, pp. 98–107.

The added amount of the development stopping agent is preferably from 0.1 to 20 g/m$^2$, more preferably from 1 to 10 g/m$^2$.

The silver halide print-out inhibitor will be further described. The terminology "print-out" as used herein means a phenomena that silver halide converts to silver directly with irradiation of strong light, not through development step. The silver halide print-out inhibitor is a compound which inhibits the print-out. Examples of compounds which have heretofore been known as print-out inhibitors include monohalogen compounds as disclosed in JP-B-54-164, trihalogen compounds as disclosed in JP-A-53-46020, compounds comprising halogen connected to aliphatic carbon atoms as disclosed in JP-A-48-45228, and polyhalogen compounds such as tetrabromoxylene as disclosed in JP-B-57-8454. Further, a development inhibitor such as 1-phenyl-5-mercaptotetrazole as disclosed in British Patent 1,005,144 is useful.

The added amount of the print-out inhibitor is preferably from $10^{-4}$ to 1 mol/mol of Ag, more preferably from $10^{-3}$ to $10^{-1}$ mol/mol of Ag.

The silver halide fixing agent (sometimes referred to as "fixing agent") will be further described hereinafter.

The silver halide fixing agent employable in the present invention is a compound capable of solubilizing silver halide and forming a silver complex salt to stabilize the silver halide. The added amount of the fixing agent is preferably from 0.2 to 5 mol, more preferably from 0.5 to 3 mol per mol of silver.

The fixing agent employable in the present invention is preferably a compound comprising in its molecule a mercapto group, thiocarbonyl group or functional group capable of forming such a group. Specific examples of such a compound include thiosulfates such as ammonium thiosulfate, sodium thiosulfate and potassium thiosulfate, and compounds represented by the following general formulae (I) to (V).

$$R—S—M \quad (I)$$

wherein R represents an alkyl group or an aryl group, each being substituted by a carboxyl group or its salt; and M represents a hydrogen atom, an alkaline metal atom, a (½) alkaline earth metal atom, an ammonium group or a group which causes cleavage of the bond between the sulfur atom and M by reaction with a base, a nucleophilic reagent or a reducing agent or on heating or by synergistic action thereof.

Referring further to the general formula (I), R is an alkyl group substituted by carboxyl group (or its salt) or an aryl group substituted by carboxyl group (or its salt). The alkyl group in unsubstituted form is preferably a $C_{1-30}$ alkyl group, particularly a $C_{2-12}$ alkyl group (e.g., ethyl, propyl, isobutyl, 3-methyl-2-butenyl, cyclohexyl, octyl). The aryl group in unsubstituted form is preferably a $C_{6-20}$ aryl group (e.g., phenyl, 1-naphthyl).

In the compound represented by the general formula (I), the sulfur atom and the carboxyl group (or its salt) on R are preferably separated by one to six carbon atoms, more preferably two or three carbon atoms, most preferably two carbon atoms.

R may be further substituted by substituents. Preferred examples of such substituents include a nitro group, a halogen atom (e.g., chlorine, bromine), a mercapto group, a cyano group, a substituted or unsubstituted alkyl group (e.g., methyl, ethyl, propyl, methoxyethyl, methylthioethyl, dimethylaminoethyl, trimethylammonioethyl, carboxymethyl, carboxyethyl, carboxypropyl, sulfoethyl, sulfomethyl, phosphonomethyl, phosphonoethyl), an aryl group (e.g., phenyl, 4-sulfophenyl), an alkenyl group (e.g., allyl), a cycloalkyl group (e.g., cyclohexyl), an alkinyl group (e.g., propargyl), aralkyl group (e.g., benzyl, 4-methylbenzyl), an alkoxy group (e.g., methoxy, ethoxy, methoxyethoxy), an aryloxy group (e.g., phenoxy), an alkylthio group (e.g., methylthio, ethylthio), an arylthio group (e.g., phenylthio), a sulfonyl group (e.g., methanesulfonyl, p-toluenesulfonyl), a carbamoyl group (e.g., unsubstituted carbamoyl, methylcarbamoyl), a thiocarbamoyl group (e.g., dimethylthiocarbamoyl), a sulfamoyl group (e.g., unsubstituted sulfamoyl, methylsulfamoyl, phenylsulfamoyl), a carbonamide group (e.g., acetamide, benzamide, methoxypropionamide), a sulfonamide group (e.g., methanesulfonamide, benzenesulfonamide), an acyloxy group (e.g., acetyloxy, benzoyloxy), a sulfonyloxy group (e.g., methanesulfonyloxy), an ureide group (e.g., unsubstituted ureide, methylureide, ethylureide, methoxyethylureide), a thioureide group (e.g., unsubstituted thioureide, methylthioureide, methoxyethylthioureide), a sulfamoylamino group (e.g., unsubstituted sulfamoylamino, dimethylsulfamoylamino), an acyl group (e.g., acetyl, 4-methoxybenzoyl), a thioacyl group (e.g., thioacetyl), a heterocyclic group (e.g., 1-morpholino, 1-piperidino, 2-pyridyl, 4-pyridyl, 2-chenyl, 1-pyrazolyl, 1-imidazolyl, 2-tetrahydrofuryl, tetrahydrochenyl), an oxycarbonyl group (e.g., methoxycarbonyl, phenoxycarbonyl, methoxyethoxycarbonyl), an oxycarbonylamino group (e.g., methoxycarbonylamino), an amino group (e.g., unsubstituted amino, dimethylamino), a sulfonic acid or salt thereof, and a hydroxyl group.

M represents a hydrogen atom, an alkaline metal atom (e.g., sodium, potassium), a (½) alkaline earth metal atom (e.g., (½) magnesium), an ammonium atom (e.g., ammonium ion, triethylammonium ion, trimethylbenzylammonium ion) or a group which causes cleavage of the bond between the sulfur atom and M by reaction with a base, a nucleophilic reagent or a reducing agent or on heating or by synergistic action thereof. Specific examples of such a group include transition metal atoms such as (½) zinc atom, and a block group to be incorporated in compounds called as precursors known in the art.

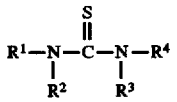

(II)

wherein $R^1$, $R^2$, $R^3$ and $R^4$ each represent an alkyl group, an aryl group, a heterocyclic group, an acyl group, or an amino group. $R^1$, $R^2$, $R^3$ and $R^4$ may be the same or different. A plurality of groups selected from these groups may be connected to each other to form a ring. Further, $R^2$, $R^3$ and $R^4$ each may be a hydrogen atom.

Referring further to the general formula (II), the alkyl group represented by $R^1$, $R^2$, $R^3$ or $R^4$ is preferably a $C_{1-30}$ alkyl group, more preferably a $C_{2-12}$ alkyl group (e.g., ethyl, propyl, isobutyl, 3-methyl-2-butenyl, cyclohexyl, octyl). The aryl group represented by $R^1$, $R^2$, $R^3$ or $R^4$ is preferably a $C_{6-20}$ aryl group (e.g., phenyl, 1-naphthyl).

The heterocyclic group represented by $R^1$, $R^2$, $R^3$ or $R^4$ is preferably a $C_{4-20}$ heterocyclic group (e.g., 1-morpholino, 2-pyridyl, 2-chenyl, 3-quinolyl). The acyl group represented by $R^1$, $R^2$, $R^3$ or $R^4$ is preferably a $C_{1-20}$ acyl group (e.g., methoxyacetyl, benzoyl). The amino group represented by $R^1$, $R^2$, $R^3$ or $R^4$ is preferably an unsubstituted or substituted amino group (e.g., dimethylamino, anilino).

$R^1$, $R^2$, $R^3$ and $R^4$ may further be substituted by substituents. Preferred examples of such substituents include carboxylic acid or salts thereof and those described as substituents on R in the general formula (I).

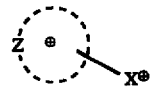

(III)

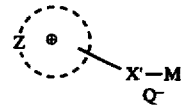

(IV)

wherein Z represents a 5- or 6-membered ring cpmprising a carbon atom, a nitrogen atom, an oxygen atom, a sulfur atom or a selenium atom; $X^-$ represents $—O^-$, $—S^-$ or $—N^-R$ (in which R represents an alkyl group, a cycloalkyl group, an alkenyl group, an alkinyl group, an aralkyl group, an aryl group or a heterocyclic group); X' represents an oxygen atom, a sulfur atom or a —NR— group (in which R is as defined above); $Q^-$ represents a counter anion; and M represents a group which causes cleavage of the bond to X' by the reaction with a base, a nucleophilic reagent or a reducing agent or on heating or by the synergistic action thereof.

Particularly preferred among these compounds are those represented by the following general formulae (IIIa) and (IVa):

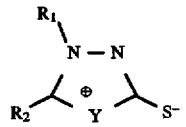

(IIIa)

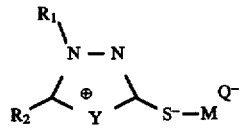

(IVa)

In the general formulae, $R_1$ and $R_2$ each represent an alkyl group, a cycloalkyl group, an alkenyl group, an alkinyl group, an aralkyl group, an aryl group, or a heterocyclic group, with the proviso that $R_2$ may be a hydrogen atom. Y represents —O—, —S— or —N($R_3$)— in which $R_3$ represents an alkyl group, a cycloalkyl group, an alkenyl group, an alkinyl group, an aryl group, a heterocyclic, an amino group, an acylamino group, a sulfonamide group, an ureide group, or a sulfamoylamino group, with the proviso that $R_1$ and $R_2$, and $R_2$ and $R_3$ may be connected to each other to form a ring.

$Q^-$ represents a counter anion. M represents a group which causes cleavage of the bond to the sulfur atom by the reaction with a base, a nucleophilic reagent or a reducing agent or on heating or by the synergistic action thereof.

The general formulae (III) and (IV) will be further described hereinafter.

Examples of the 5-membered heterocyclic group represented by Z include imidazoliums, pyrazoliums, oxazoliums, thiazoliums, triazoliums, tetrazoliums, thiadiazoliums, oxadiazoliums, thiatriazoliums, and oxatriazoliums.

R represents a substituted or unsubstituted alkyl group (e.g., methyl, ethyl, n-propyl, n-butyl, isoproyl, n-octyl, carboxyethyl, ethoxycarbonylmethyl, dimethylaminoethyl), a substituted or unsubstituted cycloalkyl group (e.g., cyclohexyl, 4-methylcyclohexyl), a substituted or unsubstituted alkenyl group (e.g., propenyl), a substituted or unsubstituted alkinyl group (e.g., propargyl, 1-methylpropargyl), a substituted or unsubstituted aralkyl group (e.g., benzyl, 4-methoxybenzyl), a substituted or unsubstituted aryl group (e.g., phenyl, 3-methoxyphenyl), and a substituted or unsubstituted heterocyclic group (e.g., pyridyl, imidazolyl, morpholino, triazolyl, tetrazolyl, chenyl).

The heterocyclic group represented by Z may be substituted by a nitro group, a halogen atom (e.g., chlorine, bromine), a mercapto group, a cyano group, a substituted or unsubstituted alkyl group (e.g., methyl, ethyl, propyl, methoxyethyl, methylthioethyl, dimethylaminoethyl, trimethylammonioethyl, carboxymethyl, carboxyethyl, carboxypropyl, sulfoethyl, sulfomethyl, phosphonomethyl, phosphonoethyl), an aryl group (e.g., phenyl, 4-sulfophenyl), alkenyl group (e.g., allyl), a cycloalkyl group (e.g., cyclohexyl), an alkenyl group (e.g., propargyl), an aralkyl group (e.g., benzyl, 4-methylbenzyl), an alkoxy group (e.g., methoxy, ethoxy, methoxyethoxy), an aryloxy group (e.g., phenoxy), an alkylthio group (e.g., methylthio, ethylthio), an arylthio group (e.g., phenylthio), a sulfonyl group (e.g., methanesulfonyl, p-toluenesulfonyl), a carbamoyl group (e.g., unsubstituted carbamoyl, methylcarbamoyl), a thiocarbamoyl group (e.g., dimethylthiocarbamoyl), a sulfamoyl group (e.g., unsubstituted sulfamoyl, methylsulfamoyl, phenylsulfamoyl), a carbonamide group (e.g., acetamide, benzamide, methoxypropionamide), a sulfonamide group (e.g., methanesulfonamide, benzenesulfonamide), an acyloxy group (e.g., acetyloxy, benzoyloxy), a sulfonyloxy group (e.g., methanesulfonyloxy), an ureide group (e.g., unsubstituted ureide, methylureide, ethylureide, methoxyethylureide), a thioureide group (e.g., unsubstituted thioureide, methylthioureide, methoxyethylthioureide), a sulfamoylamino group (e.g., unsubstituted sulfamoylamino, dimethylsulfamoylamino), an acyl group (e.g., acetyl, 4-methoxybenzoyl), a thioacyl group (e.g., thioacetyl), a heterocyclic group (e.g., 1-morpholino, 1-piperidino, 2-pyridyl, 4-pyridyl, 2-chenyl, 1-pyrazolyl, 1-imidazolyl, 2-tetrahydrofuryl, tetrahydrochenyl), an oxycarbonyl group (e.g., methoxycarbonyl, phenoxycarbonyl, methoxyethoxycarbonyl), an oxycarbonylamino group (e.g., methoxycarbonylamino), an amino group (e.g., unsubstituted amino, dimethylamino), a carboxylic acid or salt thereof, a sulfonic acid or salt thereof, a hydroxyl group, or the like.

The compound represented by the general formula (III) or (IV) may form a salt (e.g., acetate, nitrate, salicylate, hydrochloride, iodate, bromate).

In the general formula (III), $X^-$ preferably represents $—S^-$.

In the general formula (IV), X' preferably represents a sulfur atom. M represents a group which causes cleavage of the bond to X' by the reaction with a base, a nucleophilic reagent or a reducing agent or on heating or by the synergistic action thereof. Specific examples of such a group include transition metal atoms such as (½) zinc atom, and a block group to be incorporated in compounds called as precursors known in the art.

$Q^-$ is a counter anion. Preferred examples of such an anion include a halide ion (e.g., $Cl^-$, $Br^-$), $BF_4^-$, $PF_6^-$, an alkyl sulfonate ion, an aryl sulfonate ion, a monoalkyl sulfate ion, and a monoaryl sulfate ion.

The compounds represented by the foregoing general formula (IIIa) and (IVa) will be further described hereinafter.

In the general formulae (IIIa) and (IVa), $R_1$ and $R_2$ each represent a substituted or unsubstituted alkyl group (e.g., methyl, ethyl, n-propyl, t-butyl, methoxyethyl, methylthioethyl, dimethylaminoethyl, morpholinoethyl, dimethylaminoethylthioethyl, diethylaminoethyl, aminoethyl, methylthiomethyl, trimethylammonioethyl, carboxymethyl, carboxyethyl, carboxypropyl, sulfoethyl, sulfomethyl, phosphonomethyl, phosphonoethyl), a substituted or unsubstituted cycloalkyl group (e.g., cyclohexyl, cyclopentyl, 2-methylcyclohexyl), a substituted or unsubstituted alkenyl group (e.g., allyl, 2-methylallyl), a substituted or unsubstituted alkinyl group (e.g., propargyl), a substituted or unsubstituted aralkyl group (e.g., benzyl, phenethyl, 4-methoxybenzyl), an aryl group (e.g., phenyl, naphthyl, 4-methylphenyl, 4-methoxyphenyl, 4-carboxyphenyl, 4-sulfophenyl) or a substituted or unsubstituted heterocyclic group (e.g., 2-pyridyl, 3-pyridyl, 4-pyridyl, 2-chenyl, 1-pyrazolyl, 1-imidazolyl, 2-tetrahydrofuryl).

$R_2$ may be a hydrogen atom.

$R_3$ may be a substituted or unsubstituted alkyl group (e.g., methyl, ethyl, n-propyl, t-butyl, methoxyethyl, methylthioethyl, dimethylaminoethyl, morpholinoethyl, dimethylaminoethylthioethyl, diethylaminoethyl, aminoethyl, methylthiomethyl, trimethylammonioethyl, carboxymethyl, carboxyethyl, carboxypropyl, sulfoethyl, sulfomethyl, phosphonomethyl, phosphonoethyl), a substituted or unsubstituted cycloalkyl group (e.g., cyclohexyl, cyclopentyl, 2-methylcyclohexyl), a substituted or unsubstituted alkenyl group (e.g., allyl, 2-methylallyl), a substituted or unsubstituted alkinyl group (e.g., propargyl), a substituted or unsubstituted aralkyl group (e.g., benzyl, phenetyl, 4-methoxybenzyl), an aryl group (e.g., phenyl, naphthyl, 4-methylphenyl, 4-methoxyphenyl, 4-carboxyphenyl, 4-sulfophenyl), a substituted or unsubstituted heterocyclic group (e.g., 2-pyridyl, 3-pyridyl, 4-pyridyl, 2-chenyl, 1-pyrazolyl, 1-imidazolyl, 2-tetrahydrofuryl), a substituted or unsubstituted amino group (e.g., unsubstituted amino, dimethylamino, methylamino), an acylamino group (e.g., acetylamino, benzoylamino, methoxypropionylamino), a sulfonamide group (e.g., methanesulfonamide, benzenesulfonamide, 4-toluenesulfonamide), a ureide group (e.g., unsubstituted ureide, 3-methylureide) or a sulfamoylamino group (e.g., unsubstituted sulfamoylamino, 3-methylsulfamoylamino).

In the general formulae (IIIa) and (IVa), Y preferably represents —N($R_3$)—. $R_1$ and $R_3$ each preferably represent a substituted or unsubstituted alkyl group, a substituted or unsubstituted alkenyl group, a substituted or unsubstituted alkinyl group or a substituted or unsubstituted heterocyclic group. $R_2$ preferably represents a hydrogen atom, a substituted or unsubstituted alkyl group, a substituted or unsubstituted alkenyl group, a substituted or unsubstituted alkinyl group or a substituted or unsubstituted heterocyclic group.

Preferred examples of M and $Q^-$ are the same as described in the general formula (IV).

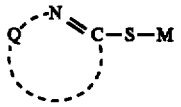

(V)

In the general formula (V), Q represents an atomic group necessary for the formation of a 5- or 6-membered heterocyclic group formed by atoms of at least one kind selected from the group consisting of carbon atom, nitrogen atom, oxygen atom and selenium atom. This heterocyclic group may be condensed with an aromatic carbon ring or a heterocyclic aromatic ring.

M represents a hydrogen atom, an alkaline metal atom, a (½) alkaline earth metal atom, an ammonium group or a group which causes cleavage of the bond between the sulfur atom and M by the reaction with a base, nucleophilic reagent or reducing agent or on heating or by the synergistic action thereof.

The compound represented by the general formula (V) will be further described hereinafter.

M represents a hydrogen atom, an alkaline metal atom (e.g., sodium, potassium), a (½) alkaline earth metal atom (e.g., (½) magnesium), an ammonium atom (e.g., ammonium ion, triethylammonium ion, trimethylbenzylammonium ion) or a group which causes cleavage of the bond to the sulfur atom by reaction with a base, a nucleophilic reagent or a reducing agent or on heating or by synergistic action thereof. Specific examples of such a group include transition metal atoms such as (½) zinc atom, and a block group to be incorporated in compounds called as precursors known in the art.

Examples of the heterocyclic group formed by Q, N and C include tetrazoles, triazoles, imidazoles, thiadiazoles, oxadiazoles, selenadiazoles, oxazoles, thiazoles, benzoxazoles, benzthiazoles, benzimidazoles, and pyrimidines.

These heterocyclic groups may be substituted by nitro group, halogen atom (e.g., chlorine, bromine), mercapto group, Cyano group, substituted or unsubstituted alkyl group (e.g., methyl, ethyl, propyl, t-butyl, methoxyethyl, methylthioethyl, dimethylaminoethyl, morpholinoethyl, dimethylaminoethylthioethyl, diethylaminoethyl, dimethylaminopropyl, dipropylaminoethyl, dimethylaminohexyl, methylthiomethyl, methoxyethoxyethoxyethyl, trimethylammonioethyl, cyanoethyl), aryl group (e.g., phenyl, 4-methanesulfonamidephenyl, 4-methylphenyl, 3-methoxyphenyl, 4-dimethylaminophenyl, 3,4-dichlorophenyl, naphthyl), alkenyl group (e.g., allyl), aralkyl group (e.g., benzyl, 4-methylbenzyl, phenethyl, 4-methoxybenzyl), alkoxy group (e.g., methoxy, ethoxy, methoxyethoxy, methylthioethoxy, dimethylaminoethoxy), aryloxy group (e.g., phenoxy, 4-methoxyphenoxy), alkylthio group (e.g., methylthio, ethylthio, propelthio, methylthioethyl, dimethylaminoethylthio, methoxyethylthio, morpholinoethylthio, dimethylaminopropylthio, piperidinoethylthio, pyrrolidinoethylthio, morpholinoethylthioethylthio, imidazolylethylthio, 2-pyridylmethylthio, diethylaminoethylthio), arylthio group (e.g., phenylthio, 4-dimethylaminophenylthio), heterocyclic oxy group (e.g., 2-pyridyloxy, 2-imidazolyloxy), heterocyclic thio group (e.g., 2-benzthiazolylthio, 4-pyrazolylthio), sulfonyl group (e.g., methanesulfonyl, ethanesulfonyl, p-toluenesulfonyl, methoxyethylsulfonyl, dimethylaminoethylsulfonyl), carbamoyl group (e.g., unsubstituted carbamoyl, methylcarbamoyl, dimethylaminoethylcarbamoyl, methoxyethylcarbamoyl, morpholinoethylcarbamoyl, methylthioethylcarbamoyl, phenylcarbamoyl), sulfamoyl group (e.g., unsubstituted sulfamoyl, methylsulfamoyl, imidazolylethylsulfamoyl, phenylsulfamoyl), carbonamide group (e.g., acetamide, benzamide, methoxypropionamide, dimethylaminopropionamide), sulfonamide group ( e.g., methanesulfonamide, benzenesulfonamide, p-toluenesulfonamide), acyloxy group (e.g., acetyloxy, benzoyloxy), sulfonyloxy group (e.g., methanesulfonyloxy), ureide group (e.g., unsubstituted ureide, methylureide, ethylureide, methoxyethylureide, dimethylaminopropylureide, methylthioethylureide, morpholinoethylureide, phenylureide), thioureide group (e.g., unsubstituted thioureide, methylthioureide, methoxyethylthioureide), acyl group (e.g., acetyl, benzoyl, 4-methoxybenzoyl), heterocyclic group (e.g., 1-morpholino, 1-piperidino, 2-pyridyl, 4-pyridyl, 2-chenyl, 1-pyrazolyl, 1-imidazolyl, 2-tetrahydrofuryl, tetrahydrochenyl), oxycarbonyl group (e.g., methoxycarbonyl, phenoxycarbonyl, methoxyethoxycarbonyl, methylthioethoxycarbonyl, methoxyethoxyethoxyethoxycarbonyl, dimethylaminoethoxycarbonyl, morpholinoethoxycarbonyl), oxycarbonylamino group (e.g., methoxycarbonylamino, phenoxycarbonylamino, 2-ethylhexyloxycarbonylamino), amino group (e.g., unsubstituted amino, dimethylamino, methoxyethylamino, anilino), carboxylic acid or salt thereof, sulfonic acid or salt thereof, hydroxyl group, or the like.

Preferred examples of the heterocyclic group include triazoles, tetrazoles, and thiadiazoles.

Specific examples of the fixing agent employable in the present invention will be listed below.

$HSCH_2COOH$ I-1

$HSCH_2CH_2COOH$ I-2

$C_{12}H_{25}-CH(SH)-COOH$ I-3

$C_6H_5CH(SH)CH_2COOH$ I-4

-continued
$HSCH_2CH(NH_2)COOH$ I-5
$HSCH_2CH(NHCOCH_3)COOK$ I-6
$HSCH_2CH(NHCOC_6H_5)COOH$ I-7
$C_6H_5COSCH_2CH(NHCOC_6H_5)COOH$ I-8
$HSCH_2CH(NHCOCH(C_2H_5)C_4H_9)COOH$ I-9
$HSCH_2CH(NHCOC_{11}H_{23})COOH$ I-10
$HSCH_2CH(NHCOOCH_2C_6H_5)COOH$ I-11
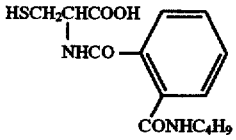
I-12
$NCCH_2CH_2SCH_2CH_2CH_2COOH$ I-13
$C_6H_5SO_2CH_2CH_2SCH_2CH(NHCOC_6H_5)COOH$ I-14
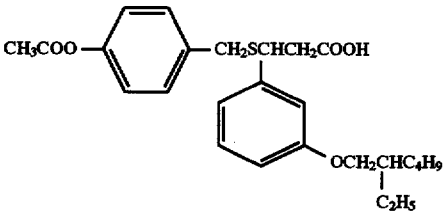
I-15
$HS(CH_2)_5COOH$ I-16
$HOOCCH(SH)CH_2COOH$ I-17
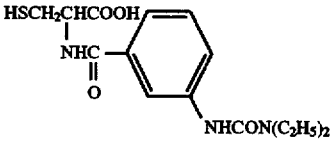
I-18
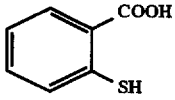
I-19
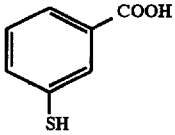
I-20
-continued
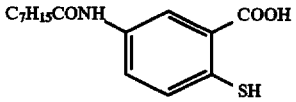
I-21
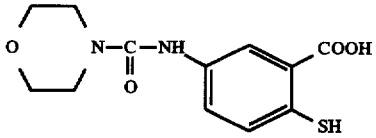
I-22
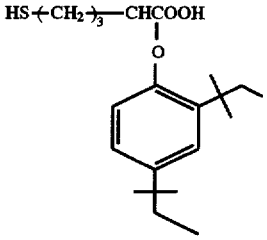
I-23
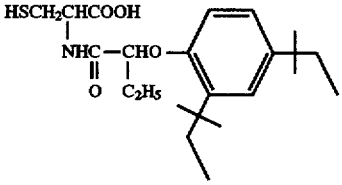
I-24
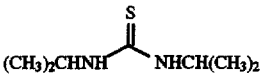
II-1
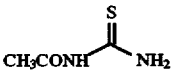
II-2
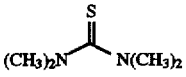
II-3
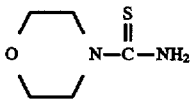
II-4
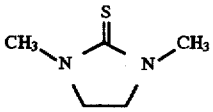
II-5
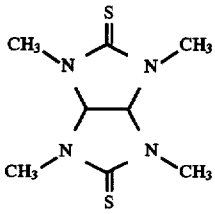
II-6
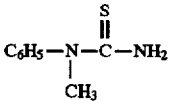
II-7

-continued
II-8
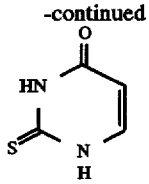
II-9
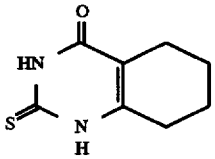
II-10
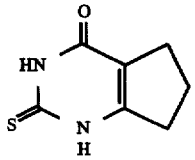
II-11
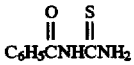
II-12
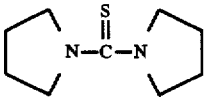
III-1
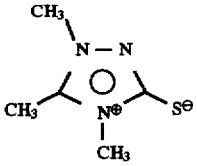
III-2
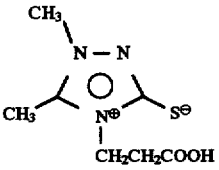
III-3
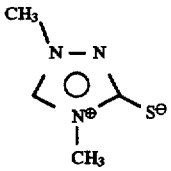
III-4
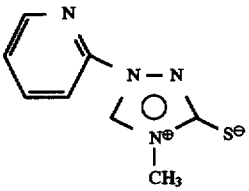
III-5
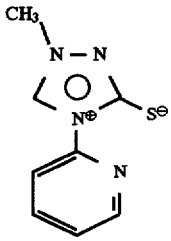
-continued
III-6
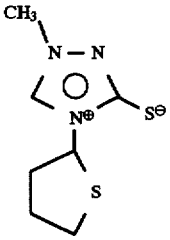
III-7
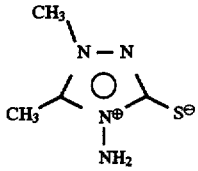
III-8
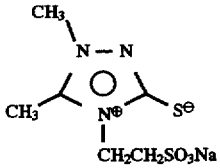
III-9
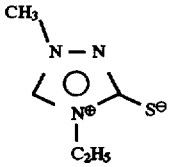
III-10
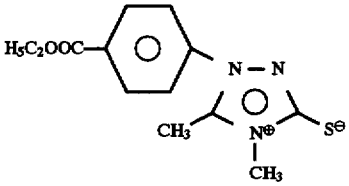
III-11
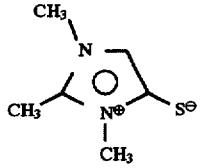
III-12
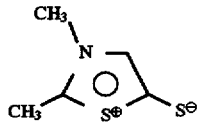
III-13
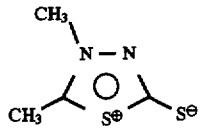
III-14
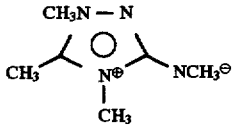

-continued
III-15
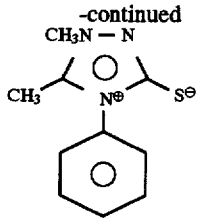
III-16
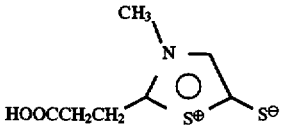
III-17
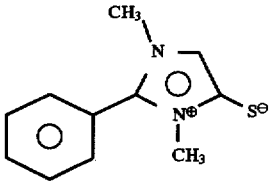
III-18
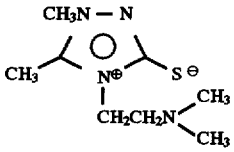
III-19
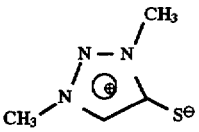
III-20
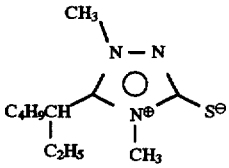
III-21
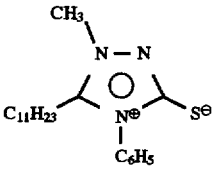
III-22
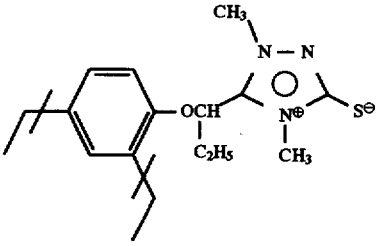
III-23
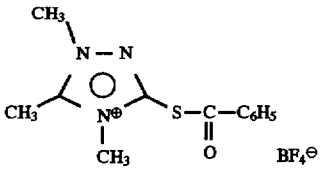
-continued
III-24
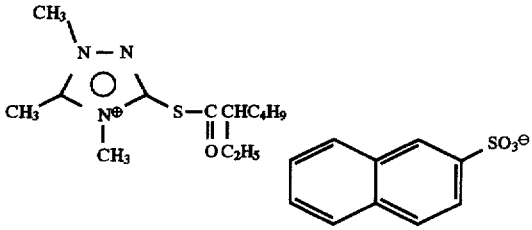
III-25
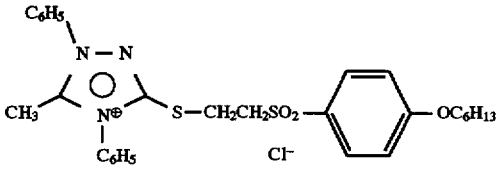
V-1
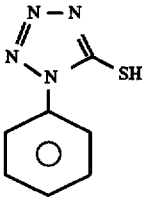
V-2
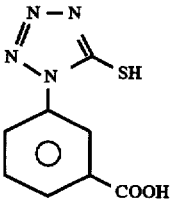
V-3
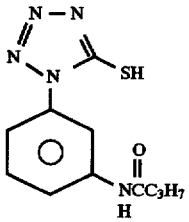
V-4
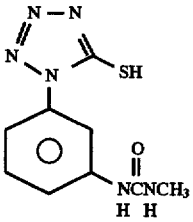
V-5
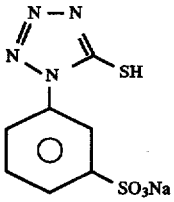

-continued
V-6
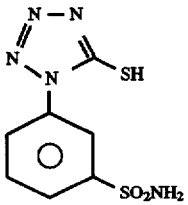
V-7
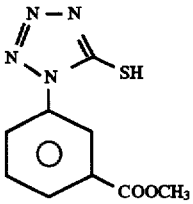
V-8
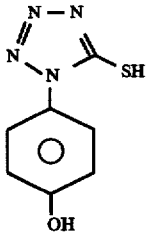
V-9
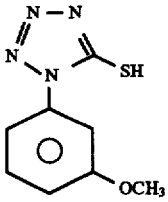
V-10
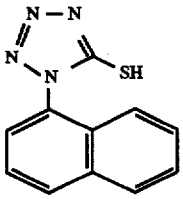
V-11
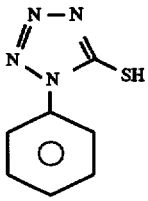
V-12
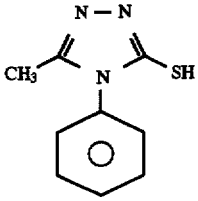
-continued
V-13
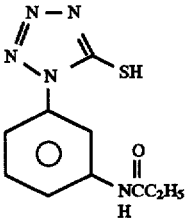
V-14
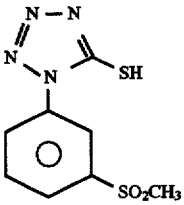
V-15
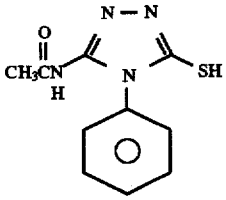
V-16
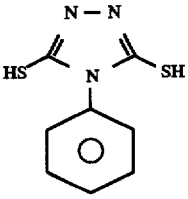
V-17
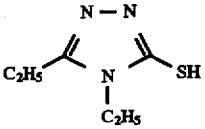
V-18
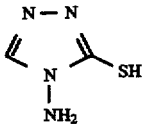
V-19
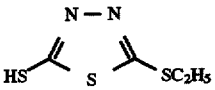
V-20
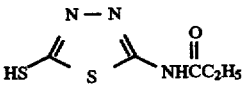
V-21
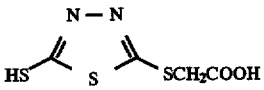
V-22
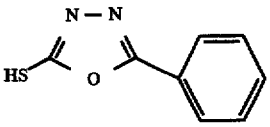

-continued

V-23

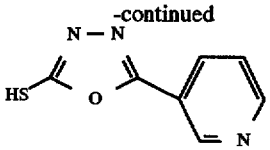

V-24

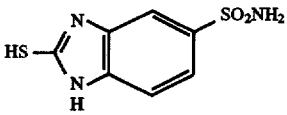

V-25

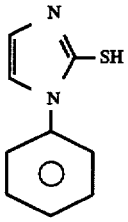

V-26

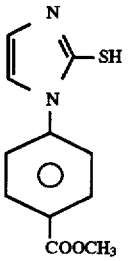

V-27

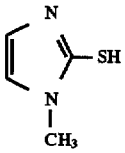

V-28

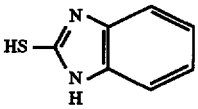

V-29

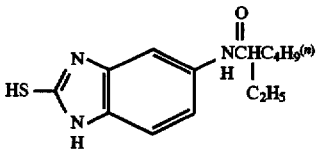

V-30

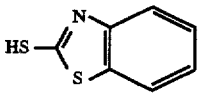

V-31

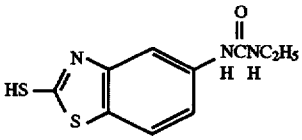

V-32

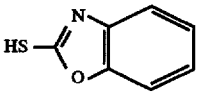

V-33

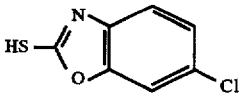

-continued

V-34

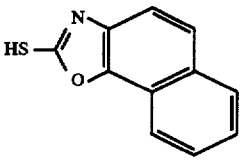

V-35

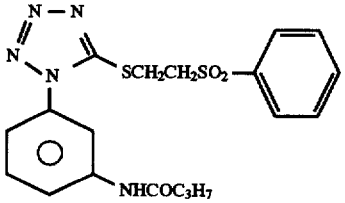

V-36

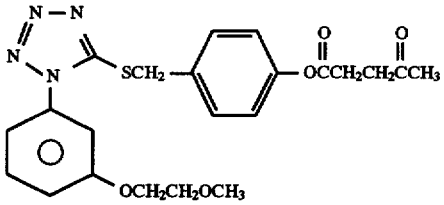

V-37

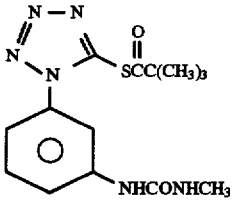

The compounds represented by the foregoing general formulae (I) to (V) of the present invention are known. The synthesis of these compounds can be easily accomplished by any suitable method as described in "Journal of Heterocyclic Chemistry", 2, 105 (1965), "Journal of Organic Chemistry", 32, 2245 (1967), "Journal of Chemical Society", 3799 (1969), "Journal of American Chemical Society", 80, 1895 (1958), "Chemical Communication", 1222 (1971), "Tetrahedron Letters", 2939 (1972), JP-A-60-87322, "Berichte der Deutschen Chemischen Gesellschaft", 38, 4049 (1905), "Journal of Chemical Society Chemical Communication", 1224 (1971), JP-A-60-122936, JP-A-60-117240, "Advances in Heterocyclic Chemistry", 19, 1 (1976), "Tetrahedron Letters", 5881 (1968), "Journal of Heterocyclic Chemistry", 5, 277 (1968), "Journal of Chemical Society Perkin Transaction I", 627 (1974), "Tetrahedron Letters", 1809 (1976), "Tetrahedron Letters", 1578 (1971), "Journal of Chemical Society", 899 (1935), "Journal of Chemical Society", 2865 (1959), "Journal of Organic Chemistry", 30, 567 (1965), JP-B-40-28496, JP-A-50-89034, U.S. Pat. Nos. 3,106,467, 3,420,670, 2,271,229, 3,137,578, 3,148,066, 3,511,663, 3,060,028, 3,271,154, 3,251,691, 3,598,599, 3,148,066, JP-B-43-4135, U.S. Pat. Nos. 3,615,616, 3,420,664, 3,071,465, 2,444,605, 2,444,606, 2,444,607, and 2,935,404.

As the material for the wall of microcapsule for containing the foregoing components there may be used a known material. As the process for the formation of the microcapsule wall there may be used a known process. Examples of the material for the wall of microcapsule include capsules made of polyamide, polyurethane, polyester, polysulfonamide, polyurea, epoxy, polysulfonate and polycarbonate prepared by interfacial polymerization, capsules made of acrylic ester, methacrylic ester, vinyl acetate, styrene-divinylbenzene, polyisocyanate-polyol, polyisocyanate-polyamine and acid chloride-polyol prepared by in-situ polymerization (from the inside of oil phase), capsules made of organic amine-acid amide-water-soluble epoxy compound, urea-formaldehyde, urea-formaldehyde-resorcinol, urea-formaldehyde-polyacrylic acid, aminoplast resin prepolymer-surface active agent, melamine-formaldehyde and heterocyclic amine-aldehyde prepared by in-situ polymerization (from the outside of oil phase, capsules made of gelatin and polyvinyl alcohol prepared by coacervation process, capsules made of polystyrene, polyvinyl chloride, polyvinyl acetate, polyvinylidene chloride, polyacrylic ester, polyester, phenolic resin, ethyl cellulose, acetic cellulose, maleic acid resin and silicone resin prepared by submerged drying process, capsules made of polyethylene, paraffin, water scale, hardened beef tallow, carnauba wax, fatty oil, fatty acid and long-chain alcohol prepared by melt dispersion cooling process, capsules made of sodium alginate, polyvinyl alcohol, gelatin, low melting alloy, wax, egg albumin and epoxy resin prepared by orifice process, and capsules made of gum arabic, polyvinyl pyrrolidone, gelatin, carboxymethyl cellulose, methyl cellulose and polyvinyl alcohol prepared by spray drying process.

Examples of the capsulization process are disclosed in "New Technique for Microcapsulization, Development of its Application, and Examples of Application", Keiei Kaihatsu Center, 1978, and "Newest Microcapsulization Technique", Sogo Gijtsu Center, 1987. Examples of the capsulization processes as disclosed in patents include processes utilizing coacervation of hydrophilic wall-forming material as disclosed in U.S. Pat. Nos. 2,800,457 and 2,800,458, and JP-A-50-140376, interfacial polymerization processes as disclosed in U.S. Pat. No. 3,287,154, British Patent 990,443, and JP-B-38-19574, JP-B-42-446, and JP-B-42-771, processes utilizing the precipitation of polymers as disclosed in U.S. Pat. Nos. 3,418,250 and 3,660,304, and JP-A-50-94112, processes using an isocyanate polyol wall-forming material as disclosed in JP-B-49-45133 and U.S. Pat. No. 3,796,669, processes using an isocyanate wall-forming material as disclosed in U.S. Pat. No. 391,451, processes using a urea-formaldehyde or urea formaldehyde-resorcinone wall-forming material as disclosed in U.S. Pat. Nos. 4,001,140, 4,087,376, and 4,089,802, processes using a wall-forming material such as melamine-formaldehyde resin and hydroxypropyl acerol as disclosed in U.S. Pat. No. 4,025,455, in-situ processes by monomer polymerization as disclosed in JP-B-36-9168 and JP-A-51-9079, polymerization dispersion cooling processes as disclosed in British Patents 927,807 and 965,074, and spray drying processes as disclosed in U.S. Pat. No. 3,111,407 and British Patent 930,422.

Examples of the high molecular compound employable in the interfacial polymerization process which have been applied for patent include polyurea as disclosed in JP-B-42-2883, polyurethane as disclosed in JP-B-42-11344, polyamide as disclosed in U.S. Pat. Nos. 3,954,666 and 3,959,464, epoxy as disclosed in JP-B-42-771, and polyester as disclosed in French Patent 1,278,621. These high molecular compounds can be used in the present invention.

Further, melt dispersion cooling methods as disclosed in JP-B-39-5911, JP-B-49-45224, and JP-A-47-11660 can be used.

Moreover, a composite wall comprising two or more of the foregoing microcapsule walls can be used. U.S. Pat. No. 4,353,809 and JP-A-56-102935 disclose the combined use of polyurea and melamine-formaldehyde resin, JP-A-55-119438 discloses the combined use of polyurea and urea-formaldehyde resin. JP-A-57-105236 discloses the combined use of epoxy resin and melamine-formaldehyde resin. JP-B-56-46995 discloses the combined use of epoxy resin and polyamide resin. These composite walls can be used in the present invention.

An inorganic wall microcapsule as disclosed in "Hyoumen (surface)", 25 (9), pp. 578–588 can be used in the present invention.

The incorporation of the core components in the microcapsules are preferably effected by a process which comprises dissolving these core components in the same high boiling organic solvent as described with reference to the incorporation of the dye-providing compound, emulsifying the solution in an aqueous solvent, and then forming a wall around the resulting oil droplets.

The average grain diameter of these microcapsules is generally from 1 to 50 μm, preferably from 3 to 20 μm.

The microcapsules may be incorporated in any photographic constituting layer which contains a hydrophilic binder. The microcapsules may be incorporated in the silver halide-containing photosensitive layer or in a layer separate from the photosensitive layer. Preferably, the microcapsules are incorporated in a layer between the photosensitive layer and the support.

The fixing agent to be used in the present invention is preferably incorporated in the photosensitive material in such an arrangement that it does not act on the photosensitive silver halide before heat development. In some detail, a slightly water-soluble fixing agent may be incorporated in the same layer as that of the photosensitive material or adjacent layers in the form of solid dispersion.

Alternatively, the water-resistant barrier layer may be incorporated in a separate layer interposed between emulsion layers. In this arrangement, the fixing agent may be water-soluble or slightly water-soluble.

The water-resistant barrier layer may comprise a water-resistant high molecular compound such as polyvinyl acetate, polyethylene vinyl acetate, polystyrene-butadiene-copolymer and polyacrylic ester. Polysulfonamides as disclosed in U.S. Pat. No. 4,283,477 are preferred.

Referring to the physical properties of the high molecular compound to be incorporated in the water-resistant barrier layer, Tg and softening temperature are preferably not higher than 80° C. and not higher than 150° C., respectively.

A layer containing the high molecular compound can be provided interposed between the fixing agent-containing layer and the photosensitive silver halide layer in the form of solution in an organic solvent (e.g., methylene chloride, acetone, toluene) to give a high molecular compound layer.

Alternatively, the foregoing high molecular compound can be applied in the form of aqueous latex solution, and then heated to form a water-resistant layer.

Examples of the support employable in the photosensitive material of the present invention include polyolefins such as polyethylene and polypropylene, polycarbonates, synthetic plastic films such as cellulose acetate, polyethylene terephthalate, polyethylene naphthalate and polyvinyl chloride, paper supports such as photographic raw paper, printing paper, baryta paper and resin-coated paper, support materials obtained by providing a reflective layer on the foregoing synthetic plastic films, and support materials as disclosed in JP-A-62-253159 (pp. 29–31).

These supports may be heat-treated at a temperature of not higher than Tg so that it has no curling as disclosed in U.S. Pat. No. 4,141,735. These supports may be surface-treated for the purpose of enhancing its adhesion to an undercoating layer for emulsion. Examples of the surface treatment employable in the present invention include glow discharge treatment, irradiation with ultraviolet rays, corona discharge treatment, and flame treatment.

Further, supports as disclosed in "Kochi Gijutsu", No. 5, Aztech, Mar. 22, 1991, pp. 44–149 can be used.

The components which can be additionally incorporated in the layers constituting the heat-developable photosensitive material of the present invention will be described hereinafter.

Examples of hardeners to be incorporated in the layers constituting the heat-developable photosensitive material include those described in the above cited Research Disclosures, U.S. Pat. Nos. 4,678,739, 41st column, and 4,791,042, JP-A-59-116655, JP-A-62-245261, JP-A-61-18942, and JP-A-4-218044. Specific examples of such hardeners include aldehyde type hardeners (e.g., formaldehyde), aziridine type hardeners, epoxy type hardeners, vinylsulfone type hardeners (e.g., N,N'-ethylene-bis (vinylsulfonylacetamide)ethane), N-methylol type hardeners (e.g., dimethylolurea), and high molecular type hardeners (e.g., compounds as described in JP-A-62-234157).

The amount of such a hardener to be used is generally from 0.001 to 1 g, preferably from 0.005 to 0.5 g per g of gelatin applied. Such a hardener may be incorporated in any layer constituting the photosensitive material or may be divisionally incorporated in two or more separate layers.

The layers constituting the heat-developable photosensitive material may comprise various fog inhibitors, photographic stabilizers or precursors thereof. Specific examples of these compounds include those disclosed in the above cited Research Disclosures, U.S. Pat. Nos. 5,089,378, 4,500,627, 4,614,702, 4,775,610, 4,626,500, and 4,983,494, JP-A-64-13546, pp. 7–9, 57–71, and 81–97, JP-A-62-174747, JP-A-62-239148, JP-A-63-264747, JP-A-1-150135, JP-A-2-110557, JP-A-2-178650, and RD 17643, 1978, pp. 24–25.

The amount of such a compound to be used is preferably from $5\times10^{-6}$ to $1\times10^{-1}$ mol, more preferably from $1\times10^{-5}$ to $1\times10^{-2}$ mol per mol of silver.

The heat-developable photosensitive material of the present invention may comprise a known discoloration inhibitor. Representative examples of organic discoloration inhibitors include hydroquinones, 5-hydroxychromans, 5-hydroxycoumarans, spirochromans, p-alkoxyphenols, hindered phenols such as bisphenols, gallic acid derivatives, methylenedioxybenzenes, aminophenols, hindered amines, and ether or ester derivatives obtained by silylation or alkylation of phenolic hydroxyl group in these compounds. Further, metallic complexes such as (bissalicylaldoximate) nickel complex and (bis-N,N-dialkyldithiocarbamate)nickel complex can be used.

A compound comprising both hindered amine moiety and hindered phenol moiety in the same molecule as disclosed in U.S. Pat. No. 4,268,593 can exert a good effect of inhibiting the deterioration of a yellow dye image due to heat, moisture and light. In order to inhibit the deterioration of a magenta dye image, particularly due to light, spiroindanes as disclosed in JP-A-56-159644 and hydroquinonediether and monoether-substituted chromans as disclosed in JP-A-55-89835 can be used to advantage.

The layers constituting the heat-developable photosensitive material can comprise various surface active agents for the purpose of aiding coating, improving peelability and slip properties, inhibiting electrification, accelerating development or like purposes. Specific examples of such surface active agents are described in the above cited Research Disclosures, JP-A-62-173463, and 62-183457.

The layers constituting the heat-developable photosensitive material can comprise an organic fluoro compound incorporated therein for the purpose of improving slip properties and peelability, inhibiting electrification or like purposes. Typical examples of such an organic fluoro compound include fluoro surface active agents as disclosed in JP-B-57-9053, 8th to 17th columns, JP-A-61-20944, and JP-A-62-135836, and hydrophobic fluorine compounds such as oil fluorinic compound, e.g., fluorine oil, and solid fluorine compound resin, e.g., ethylene tetrafluoride resin.

The heat-developable photosensitive material of the present invention can comprise a matting agent for the purpose of inhibiting adhesion, improving slipperiness, matting the surface thereof or like purposes. Examples of matting agents employable in the present invention include compounds disclosed in JP-A-61-88256, page 29, such as silicon dioxide, polyolefin and polymethacrylate, and compounds disclosed in JP-A-63-274944 and JP-A-63-274952 such as benzoguanamine resin bead, polycarbonate resin bead and AS (acrylonitrile styrene) resin bead. Further, compounds as disclosed in the above cited Research Disclosures can be used. These matting agents can be incorporated in an underlayer, if desired, as well as an uppermost layer (protective layer).

In addition, the layers constituting the heat-developable photosensitive material may comprise a thermal solvent, an anti-foaming agent, a bacteriacide, a mildewproofing agent, a colloidal silica, etc. incorporated therein. These additives are further described in JP-A-61-88256, pp. 26–32, JP-A-3-11338, and JP-B-2-51496.

Examples of methods for imagewise exposing the heat-developable photosensitive material to record an image thereon include a method which comprises directly photographing scene or persons using a camera or the like, a method which comprises exposure through a reversal film or negative film using a printer or enlarger, a method which comprises scanning exposure to an original image through a slit using an exposing apparatus in a copying machine, a method which comprises scanning exposure to light emitted by a light emitting diode or various lasers (e.g., laser diode, gas laser) excited by an electrical signal representative of image data (as disclosed in JP-A-2-129625, and Japanese Patent Application Nos. 3-338182, 4-9388, and 4-281442), and a method which comprises exposure directly or through an optical system to image data outputted to an image display apparatus such as CRT, liquid crystal display, electroluminescence display and plasma display.

Examples of light sources to be used in recording an image on the heat-developable photosensitive material include natural light, tungsten lamp, light emitting diode, laser, CRT, and other light sources as described in U.S. Pat. No. 4,500,626, 56th column, JP-A-2-53378, and JP-A-2-54672.

Further, a wavelength conversion element in which a nonlinear optical material is combined with a coherent light source such as laser can be used to effect imagewise exposure. The nonlinear optical material is a material capable of developing nonlinearity between polarization and electric field created when a strong photoelectric field such as laser is given. Inorganic compounds such as lithium niobate, potassium dihydrogenphosphate (KDP), lithium iodate and $BaB_2O_4$, urea derivatives, nitroaniline derivatives, nitropyridine-N-oxide derivatives such as 3-methyl-4-nitropyridine-N-oxide (POM), and compounds as described in JP-A-61-53462 and JP-A-62-210432. As wavelength conversion elements there have been known single crystal light guide type wavelength conversion element, fiber type wavelength conversion element, etc. Any of these types of wavelength conversion elements can be effectively used.

Examples of the image data which can be used include image signal obtained from video camera, electronic still camera, etc., television signal stipulated by National Television Signal Code (NTSC), image signal obtained by dividing an original image into many pixels by a scanner, and image signal produced by computers such as CG and CAD.

The heat-developable photosensitive material may comprise an electrically conductive heating element layer as a heating means for heat development. In this case, as such a heating element there may be used one disclosed in JP-A-61-145544.

The heating temperature in the heat development process is generally from about 80° C. to 180° C., preferably from 80° C. to 150° C., more preferably from 80° C. to 135° C. The heating time is generally from 0.1 to 60 seconds, preferably from 0.1 to 30 seconds.

Examples of the heating means at the development process include a method which comprises bringing the material into contact with a heated block or plate, a hot plate, a hot presser, heat roller, halogen lamp heater, infrared lamp heater, far infrared lamp heater, etc., and a method which comprises passing the material through a high temperature atmosphere.

The process of the present invention includes a step of pressing the heat-developable photosensitive material to rupture microcapsules. As the pressing method there may be used a known method.

For example, the photosensitive material may be clamped between a pair of press plates of a presser and the like. Alternatively, these photographic elements may be pressed by a pressure roller such as nip rolls while being carried thereon.

Examples of uniform high pressure pressing method using nip rolls include a method which comprises the use of gravure roll as disclosed in JP-A-63-10161, a method which comprises the use of small diameter roller as disclosed in JP-A-63-70253, a method which comprises the use of roll traverse as disclosed in JP-A-63-70254, a method which comprises the use of three-roll as disclosed in JP-A-63-143551, and a method which comprises the use of spline roller as disclosed in JP-A-63-70255. A dot impact apparatus may be used to continuously press the heat-developable photosensitive material. For details, reference can be made to JP-A-62-244054.

Further, pressing can be accomplished by blowing high pressure air through an air gun or by the use of an ultrasonic wave generator, piezoelectric element or the like.

The pressure thus applied preferably exceeds 500 kg/cm$^2$, more preferably not less than 700 kg/cm$^2$. The upper limit is not particularly limited, but it is usually 2,000 kg/cm$^2$.

If the core substance in microcapsules normally stays solid or waxy, the heat-developable photosensitive material may be heated at the same time with pressing or may be pressed after pre-heating. In this case, the heating temperature is generally from 15° C. to 120° C., preferably from 30° C. to 100° C. The rate at which pressure transfer is effected is preferably from 10 mm/sec to 100 mm/sec.

Popular among the foregoing methods is a method which comprises pressing the heat-developable photosensitive material while being carried between at least two cylindrical rollers.

The material of the roller is further described in the above cited patents. A hard material which can withstand the pressure thus applied is preferred. In some detail, hard rubber or metal is preferred. In order to enhance the durability of the roller, the roller may be subjected to ceramic coating.

The diameter of the at least two rollers which are brought into direct contact with the material is preferably from 5 mm to 80 mm. The diameter of a backup roller, if used, is preferably from 10 mm to 60 mm. The diameter of these rollers are preferably smaller in the light of weight and occupation in the apparatus. These rollers may have the same or different diameters.

The shape of the roller is normally cylindrical. However, the roller is thicker or finer at the central portion than the other portion. Alternatively, the roller may be roughened as in gravure roller.

As disclosed in JP-A-4-22949, the roller is preferably equipped with a pressure release mechanism.

The present invention will be further described in the following examples, but the present invention should not be construed as being limited thereto. Otherwise indicated, the percentage is by weight.

EXAMPLE 1

(1) Preparation and Coating of Dispersion of Microcapsules Containing Silver Halide Fixing Agent 11.7 g of a 18.6% aqueous solution of an isobutylene-maleic anhydride copolymer which had been processed with an alkali so that it was ring-opened and 54 g of a 2.9% aqueous solution of pectin were mixed. The mixture was then adjusted with a 10% sulfuric acid to pH 4 to prepare an aqueous solution of protective colloid. On the other hand, 10 g of the silver halide fixing agent described later, 10 g of tricresyl phosphate and 40 g of ethyl acetate were mixed to make a solution. The solution thus obtained was then added to the foregoing aqueous solution of protective colloid. The mixture was then subjected to emulsion by means of a homogenizer to obtain oil droplets having an average particle diameter of 6 μm. To 70 g of the emulsion were then added 8.3 g of a 40% aqueous solution of urea, 2.8 g of a 11% aqueous solution of resorcinol, 8.6 g of a 37% aqueous solution of formalin, and 2.7 g of a 8.8% aqueous solution of ammonium sulfate. The mixture was then thoroughly stirred. The mixture was then heated to a temperature of 60° C. for 2 hours with stirring. After cooled, the mixture was adjusted with a 10% aqueous solution of sodium hydroxide to pH 7. To the emulsion was then added 3.6 g of a 31% aqueous solution of sodium bisulfate to prepare a dispersion of microcapsules containing a silver halide fixing agent.

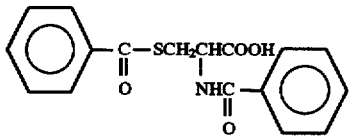

5 g of the microcapsule dispersion thus obtained was mixed with 4 g of a 5% aqueous solution of PVA205 (available from Kuraray Co., Ltd.) and 1 g of a 5% aqueous solution of the surface active agent (WW-1) describe below. The coating solution thus prepared was then coated on a clay-coated paper support in such an amount that the wet coated amount reached 50 ml/m$^2$.

WW-1

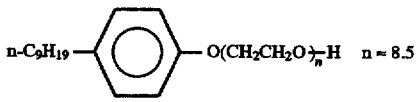

(2) Coating of Emulsion Layer and Base Precursor Layer

The preparation of a blue-sensitive silver halide emulsion will be described hereinafter.

To an aqueous solution of gelatin (obtained by adding 31.6 g of gelatin, 2.5 g of potassium bromide and 13 mg of Compound (a) to 584 ml of water, and then heating the aqueous solution to a temperature of 70° C.) which had been vigorously stirred was added the solution (2) set forth in Table 1. When 10 seconds passed after the beginning of the addition of the Solution (2), the addition of the solution (1) began. The addition of the solutions (1) and (2) was then completed in 30 minutes. When 5 minutes passed after the completion of the addition of the solution (2), the addition of the solution (4) set forth in Table 1 began. When 10 seconds passed after the beginning of the addition of the solution (4), the addition of the solution (3) began. The addition of the solution (3) was completed in 27 minutes and 50 seconds. The addition of the solution (4) was completed in 28 minutes. The emulsion was then rinsed and desalted (with a precipitating medium (c) at pH 3.9). To the emulsion thus processed were then added 24.6 g of lime-treated ossein gelatin and 56 mg of a compound (b) so that it was adjusted to pH 6.1 and pAg 8.5. The emulsion was then subjected to optimum chemical sensitization with 0.55 mg of sodium thiosulfate at a temperature of 65° C. To the emulsion were then added 0.35 g of a sensitizing dye (f), 56 mg of a fog inhibitor, and 2.3 ml of a compound (e) as a preservative. The emulsion was then cooled. As a result, 582 g of a monodisperse emulsion of octahedral silver bromide grains having an average grain size of 0.55 μm was obtained.

TABLE 1

| | Solution (1) | Solution (2) | Solution (3) | Solution (4) |
|---|---|---|---|---|
| $AgNO_3$ | 15.8 g | — | 72.2 g | — |
| $NH_4NO_3$ | 68.0 mg | — | 308 mg | — |
| KBr | — | 11.4 g | — | 52.2 g |
| Water to make | 134 ml | 134 ml | 194 ml | 195 ml |

Compound (a)

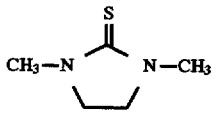

Compound (b)

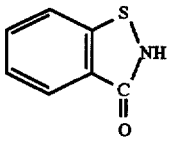

Precipitating agent (c)

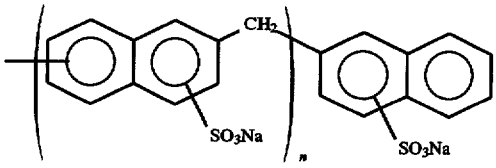

TABLE 1-continued

| | Solution (1) | Solution (2) | Solution (3) | Solution (4) |
|---|---|---|---|---|

Fog inhibitor (d)

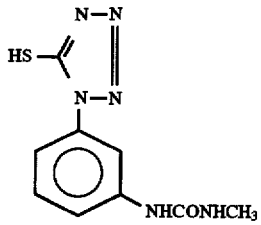

Compound (e)

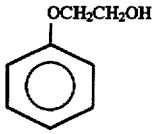

Dye (f)

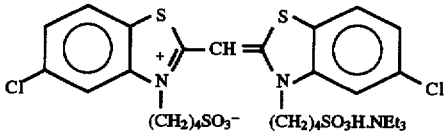

The preparation of a bentotriazole silver will be described hereinafter.

6.5 g of benzotriazole and 10 g of gelatin were dissolved in 1,000 l of water. The solution was then stored at a temperature of 50° C. with stirring. To the solution was then added a solution of 8.5 g of $AgNO_3$ in 100 ml of water in 2 minutes. The pH value of the emulsion was then properly adjusted so that precipitation occurred to remove excess salts therefrom. Thereafter, the pH value of the emulsion was adjusted to 6.0 to obtain 400 g of a benzotriazole silver emulsion.

The preparation of a dispersion of coupler and reducing agent will be described hereinafter.

10 g of Coupler (Y-1) and 5 g of 2,6-dichloro-p-aminophenol as a reducing agent were dissolved in a mixture of 10 ml of tricresyl phosphate and 30 ml of ethyl acetate. The solution thus obtained was emulsion-dispersed in 110 g of a 10 wt. % aqueous solution of gelatin containing 1.0 g of sodium dodecylbenzenesulfonate at a temperature of 50° C. to prepare a dispersion of coupler and reducing agent.

Y-1

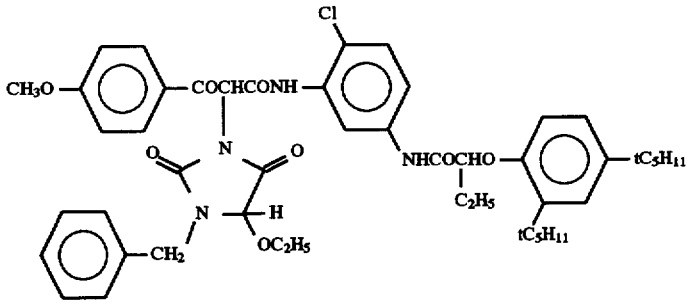

7.2 g of the foregoing blue-sensitive silver halide emulsion, 8 g of the foregoing benzotriazole silver dispersion, 19.5 g of the foregoing emulsion of coupler and reducing agent, 8 g of a 10% aqueous solution of sorbitol (thermal solvent), 1 g of a 5% aqueous solution of (WW-1), and 13 g of water were mixed. The obtained coating solution was then coated on the foregoing fixing agent-containing microcapsule-coated sheet in such a manner that the wet coated amount reach 28 ml/m$^2$. A 2.2% aqueous solution of gelatin containing 1.6% of guanidinetrichloroacetic acid was then coated on the sheet in such an amount that the wet coated amount reached 43 ml/m$^2$.

(3) Formation and Evaluation of Image

The heat-developable photosensitive material thus obtained was imagewise exposed to light, and then heated over a 140° C. heating plate for 10 seconds. As a result, the heat-developable photosensitive material showed color development to yellow on the exposed area. The sheet was passed through a pressure roller having a diameter of 3 cm at a temperature of 70° C. under a pressure of 300 kg/cm$^2$ at a rate of 2 cm/sec. The sample was then measured for reflection density on the exposed area and unexposed area by means of a Type X-LITE 310 densitometer. The results of the reflection density on the exposed area and unexposed area were 1.1 and 0.15, respectively. The sample which had not been pressured for comparison showed a reflection density of 1.2 and 0.2 on the exposed area and unexposed area, respectively. These samples were each irradiated with light from a 20 W fluorescent lamp placed 15 cm apart therefrom for 24 hours. As a result, the sample of the present invention showed little or no rise in Dmin. On the contrary, the comparative sample showed a Dmin rise to 1.0.

EXAMPLE 2

(1) Preparation and Coating of Dispersion of Microcapsules Containing Development Stopping Agent A dispersion of microcapsules containing a development stopping agent was prepared in the same manner as in the preparation of microcapsule containing a silver halide fixing agent of Example 1 except that 60 g of a development stopping agent (acid oil) described below was used instead of 10 g of the fixing agent, 10 g of tricresyl phosphate and 40 g of ethyl acetate. The dispersion was then coated on a gelatin-undercoated polyethylene terephthalate film (100 μm) in the same manner as in Example 1.

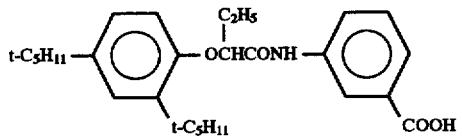

(2) Coating of Emulsion Layer and Base Precursor Layer

An emulsion was coated on the foregoing development stopping agent-containing microcapsule-coated sheet in the same manner in the same manner as in Example 1 except that Coupler (Y-2) was used instead of Coupler (Y-1).

9.8 g of a 14% aqueous solution of gelatin, 1.4 g of a solution containing 8% of silica (matting agent) and 8% of gelatin, 5.8 g of a dispersion containing 25% of a base precursor (BP-1) described below and 3% of gelatin, 38 g of water, 1 g of a 5% aqueous solution of WW-1, 0.7 g of a 5% aqueous solution of WW-2 described below, and 13 g of a 10% aqueous solution of sorbitol were mixed. The coating solution thus obtained was then coated on the foregoing emulsion-coated sheet in such an amount that the wet coated amount reached 43 ml/m$^2$.

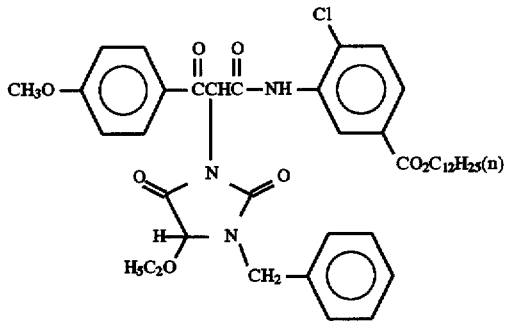

Y-2

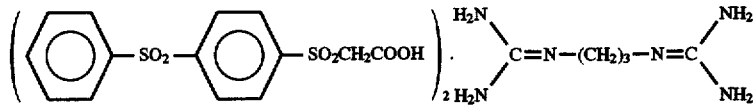

BP-1

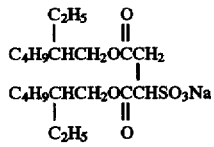

WW-2

(3) Formation and Evaluation of Image

The sample thus obtained was exposed to light, heat-developed, and then pressed in the same manner as in Example 1 to obtain an image. The sample thus processed was then irradiated with light from fluorescent lamp in the same manner as in Example 1. As a result, the sample showed little Dmin rise.

COMPARATIVE EXAMPLE 1

A comparative sample 1 was prepared in the same manner as in Example 1 except that the silver halide fixing agent-containing microcapsule-coated layer was not provided. The comparative sample was exposed to light, heat-developed, and then irradiated with light from fluorescent lamp in the same manner as in Example 1. As a result, the sample showed a Dmin rise from 0.2 to 1.0.

COMPARATIVE EXAMPLE 2

A comparative sample 2 was prepared in the same manner as in Example 2 except that the development stopping agent-containing microcapsule-coated layer was not provided. The comparative sample was exposed to light, heat-developed, and then irradiated with light from fluorescent lamp in the same manner as in Example 2. As a result, the sample showed a remarkable Dmin rise.

EXAMPLE 3

(1) Preparation and Coating of Dispersion of Microcapsules Containing Image Formation Accelerator A dispersion of microcapsules containing an image formation accelerator was prepared in the same manner as in the preparation of microcapsules containing a silver halide fixing agent of Example 1 except that 60 g of an image formation accelerator (amide oil) described below was used instead of 10 g of the fixing agent, 10 g of tricresyl phosphate and 40 g of ethyl acetate. The dispersion thus obtained was then coated on a gelatin-undercoated polyethylene terephthalate film (100 μm) in the same manner as in Example 1.

$C_{11}H_{23}CON(C_2H_5)_2$ (2) Coating of Emulsion Layer and Base Precursor Layer The same emulsion layer and base precursor layer as used in Example 2 were coated on the foregoing image formation accelerator-containing microcapsule-coated sheet.

(3) Formation and Evaluation of Image

The sample thus obtained was exposed to light in the same manner as in Example 1. The sample thus exposed was then pressed in the same manner as in Example 1 so that the amide oil was released. The sample was then heated to a temperature of 140° C. for 5 seconds. As a result, a good image was obtained. Another sample was not pressed for comparison. This comparative sample needed to be heated to a temperature of 140° C. for 10 seconds to attain the same Dmax value as the sample of the present invention.

EXAMPLE 4

(1) Preparation and Coating of Print-out Inhibitor-containing Microcapsule Dispersion A dispersion of print-out inhibitor-containing microcapsules was prepared in the same manner as in the preparation of microcapsules containing a silver halide fixing agent of Example 1 except that 0.1 g of a print-out inhibitor described below and 59.9 g of tricresyl phosphate were used instead of 10 g of the fixing agent, 10 g of tricresyl phosphate and 40 g of ethyl acetate. The dispersion thus obtained was then coated on a gelatin-undercoated polyethylene terephthalate film (100 μm) in the same manner as in Example 1.

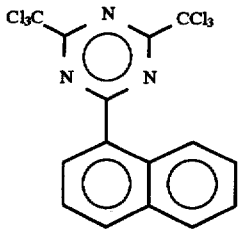

(2) Coating of Emulsion Layer and Base Precursor Layer

The same emulsion layer and base precursor layer as used in Example 1 were coated on the foregoing print-out inhibitor-containing microcapsule-coated sheet.

(3) Formation and Evaluation of Image

The sample thus obtained was exposed to light, developed, heat-developed, and then pressed in the same manner as in Example 1 to obtain an image. The sample thus processed was then irradiated with light from fluorescent lamp in the same manner as in Example 1. As a result, the sample showed as small Dmin rise. Another sample was not pressed for comparison. This comparative sample showed a remarkable Dmin rise.

EXAMPLE 5

The blue-sensitive silver halide emulsion and benzotriazole silver were prepared in the same manner as in Example 1.

The preparation of a dispersion of coupler and reducing agent will be described hereinafter.

10 g of Coupler (Y-2) (the same as in Example 2) and 5 g of 2,6-dichloro-p-aminophenol as a reducing agent were dissolved in a mixture of 10 ml of tricresyl phosphate and 30 ml of ethyl acetate. The solution thus obtained was then emulsion-dispersed in 110 g of a 10 wt. % aqueous solution of gelatin containing 1.0 g of sodium dodecylbenzenesulfonate at a temperature of 50° C. to prepare a dispersion of coupler and reducing agent.

An aqueous solution of gelatin containing 2% of ammonium thiosulfate was applied to a support to a wet thickness of 100 μm as a first layer containing a fixing agent.

A solution of 10 g of a polyvinyl acetate (available from Aldorich Corporation) in a mixture of 20 g of methylene chloride and 20 g of ethyl acetate was coated on the first layer to a wet thickness of 50 μm as a second layer (interlayer).

A coating solution comprising 20 g of the dispersion of coupler and reducing agent, 10 g of the benzotriazole silver emulsion, 6 g of the blue-sensitive silver halide emulsion, 10 g of water and 5 g of urea as a thermal solvent was wet-coated on the second layer as a third layer, and then dried. A gelatin protective layer containing 1 wt. % of guanidinetrichloroacetic acid was coated on the third layer to prepare a heat-developable photosensitive material.

The heat-developable photosensitive material thus obtained was imagewise exposed to light, and then heated to a temperature of 135° C. for 5 seconds.

The heat-developable photosensitive material which had been thus processed was immediately measured for image density on the exposed area and fog density on the unexposed area by means of a Type X-LITE 310 densitometer (available from X-LITE Corporation). The yellow density on the image area and fogged area were 0.65 and 0.12, respectively.

The heat-developable photosensitive material which had been processed was then irradiated with light from a 20-w desk fluorescent lamp placed 15 cm apart therefrom for 24 hours. The heat-developable photosensitive material was then measured for image density and fog density. The results of the image density and fog density were 0.64 and 0.14, respectively, showing an extremely small density change.

COMPARATIVE EXAMPLE 3

A heat-developable photosensitive material was prepared as a comparative specimen in the same manner as in Example 5 except that ammonium thiosulfate to be incorporated in the first layer was not omitted.

The heat-developable photosensitive material thus prepared was measured for image density and fog density shortly after processing and after irradiation with light from fluorescent lamp in the same manner as in Example 5.

The image yellow density and fog yellow density shortly after processing were 1.20 and 0.35, respectively. The image yellow density and fog yellow density after irradiation with light from fluorescent lamp were 1.5 and 1.45, respectively.

The results show that the heat-developable photosensitive material of Example 5 according to the present invention is less liable to fog and is excellent in the light fastness of image.

EXAMPLE 6

A heat-developable photosensitive material was prepared in the same manner as in Example 5 except that an aqueous solution of gelatin set forth in Table 2 was used instead of the aqueous solution of gelatin containing ammonium thiosulfate to be incorporated in the first layer.

The preparation of the coating solution for the first layer set forth in Table 2 will be described hereinafter.

50mmol of an additive was dissolved in a mixture of 10 ml of tricresyl phosphate, 30 ml of ethyl acetate and 30 ml of cyclohexanone. The solution thus obtained was then emulsion-dispersed in 50 g of a 10wt. % gelatin solution containing 2.5 ml of a 1N aqueous solution of sodium hydroxide and 0.5 g of sodium dodecylbenzenesulfonate at a temperature of 50° C. to prepare 100 g of a dispersion of fixing agent.

To 10 g of the dispersion thus prepared were then added 10 g of urea and 80 g of a 10% aqueous solution of gelatin. The coating solution thus obtained was then coated on a support to a wet thickness of 100 μm.

The photosensitive material was imagewise exposed to light, and then heat-developed at a temperature of 140° C. for 30 seconds. The photosensitive material was measured for image density and fog density shortly after processing and after irradiation with light from fluorescent lamp. As a result, the photosensitive material was found to be less liable to fog and showed a small density change on the fogged area as in Example 5. The results are set forth in Table 2.

TABLE 2

| | First layer | Added amount | Shortly after processing | | After 24 hours of irradiation with fluorescent light | |
|---|---|---|---|---|---|---|
| | Fixing agent | Concentration* | Image density | Fog density | Image density | Fog density |
| 1 | I-17 | 5 | 0.65 | 0.15 | 0.66 | 0.14 |
| 2 | I-4 | 5 | 0.55 | 0.12 | 0.55 | 0.13 |
| 3 | I-22 | 5 | 0.71 | 0.19 | 0.73 | 0.22 |
| 4 | II-5 | 4 | 0.75 | 0.31 | 0.81 | 0.32 |
| 5 | III-21 | 10 | 0.81 | 0.16 | 0.81 | 0.16 |
| 6 | III-24 | 10 | 0.85 | 0.21 | 0.81 | 0.21 |
| 7 | V-1 | 5 | 0.92 | 0.25 | 0.9 | 0.31 |
| 8 | V-35 | 5 | 0.83 | 0.17 | 0.85 | 0.23 |

*Added amount (mmol) per 100 g of 10 wt. % aqueous solution of gelatin

EXAMPLE 7

An aqueous solution of gelatin having the same composition as set forth in Table 2 of Example 6 was coated on a support to a wet thickness of 100 μm as a first layer containing a fixing agent.

An aqueous solution obtained by diluting a polyethylene vinyl acetate latex (Panflex OM-4000; Kuraray Co., Ltd.) to a solid content of 10% by weight was coated on the first layer to a wet thickness of 50 μm as a second layer (interlayer), dried, and then heated to a temperature of 75° C. for 5 hours to form a film.

A coating solution comprising 20 g of the foregoing dispersion of coupler and reducing agent, 10 g of the benzotriazole silver emulsion, 6 g of the foregoing blue-sensitive silver halide emulsion, 10 g of water, and 5 g of urea as a thermal solvent was coated on the second layer as a third layer, and then dried. A gelatin protective layer containing 2 wt. % of guanidinephenylsulfonylacetic acid was then coated on the third layer to obtain a heat-developable photosensitive material.

The heat-developable photosensitive material thus obtained was imagewise exposed to light, and then heat-developed at a temperature of 150° C. for 30 seconds. The photosensitive material was measured for image density and fog density shortly after processing and after irradiation with light from fluorescent lamp. As a result, the photosensitive material was found to be less liable to fog and showed a small density change on the fogged area as in Example 5. The results are set forth in Table 3.

The method for the solid dispersion of a fixing agent will be described hereinafter.

50 mmol of a fixing agent V-20 in powder form was mixed with 50 g of a 15% aqueous solution of gelatin and 50 ml of water containing 0.5 g of a nonionic surface active agent ($n\text{-}C_6H_{19}—C_6H_4—O—(—CH_2CH_2—O—)_8—H$). The mixture was stirred with 100 g of 200-mesh glass beads for 1 hour. The resulting dispersion was filtered. The dispersion was then adjusted with a 1N aqueous solution of sulfuric acid and a 1N aqueous solution of sodium hydroxide to from 6.5 to 6.8. The yield of the dispersion was 65 g.

To 10 g of the foregoing dispersion were then added 10 g of urea and 80 g of a 10% aqueous solution of gelatin. The resulting coating solution was then coated on the support to a wet thickness of 100 μm.

A second and above layers were coated in the same manner as in Example 6 to prepare a heat-developable photosensitive material. The heat-developable photosensitive material thus prepared was imagewise exposed to light, and then heat-developed at a temperature of 140° C. for 30 seconds. The photosensitive material was measured for image density and fog density shortly after processing and after irradiation with light from fluorescent lamp. The image yellow density and fog yellow density were 0.60 and 0.20, respectively. The image yellow density and fog yellow density after irradiation with light from fluorescent lamp were 0.65 and 0.25, respectively. This shows that the photosensitive material is less liable to fog and exhibits a small density change on the fogged area.

While the invention has been described in detail and with reference to specific embodiments thereof, it will be appar-

TABLE 3

| | First layer | Added amount | Shortly after processing | | After 24 hours of irradiation with fluorescent light | |
|---|---|---|---|---|---|---|
| | Fixing agent | Concentration* | Image density | Fog density | Image density | Fog density |
| 1 | I-17 | 5 | 0.67 | 0.17 | 0.67 | 0.18 |
| 2 | I-4 | 5 | 0.56 | 0.15 | 0.55 | 0.16 |
| 3 | I-22 | 5 | 0.73 | 0.17 | 0.74 | 0.18 |
| 4 | II-5 | 4 | 0.77 | 0.29 | 0.78 | 0.31 |
| 5 | III-21 | 10 | 0.81 | 0.15 | 0.83 | 0.16 |
| 6 | III-24 | 10 | 0.83 | 0.22 | 0.85 | 0.21 |
| 7 | V-1 | 5 | 0.88 | 0.23 | 0.89 | 0.29 |
| 8 | V-35 | 5 | 0.85 | 0.17 | 0.88 | 0.22 |
| 9 | None | 0 | 1.22 | 0.40 | 1.15 | 1.05 |

*Added amount (mmol) per 100 g of 10 wt. % aqueous solution of gelatin ent to one skilled in the art that various changes and modifications can be made therein without departing from the spirit and scope thereof.

What is claimed is:

1. A dry image formation process which comprises imagewise exposing a heat-developable photosensitive material to light, and then heat-developing the heat-developable photosensitive material to obtain an image, the heat-developable photosensitive material comprising a support having provided thereon a photosensitive layer comprising at least a silver halide, a binder and a reducing agent, wherein the heat-developable photosensitive material further comprises a component isolated as an internal phase in microcapsules, said component being a silver halide fixing agent, a development stopping agent, or a silver halide print-out inhibitor, and wherein the heat-developable photosensitive material is pressed before or after heat development so that the microcapsules are ruptured to release the internal phase and cause the component to be diffused into the photosensitive layer, allowing the function of the component to be fulfilled.

2. The dry image formation process of claim 1, wherein the component to be isolated by microcapsules is a silver halide fixing agent.

3. The dry image formation process of claim 1, wherein the component to be isolated by microcapsules is a development stopping agent.

4. The dry image formation process of claim 1, wherein the component to be isolated by microcapsules is a silver halide print-out inhibitor.

5. An image formation process which comprises heat-developing a heat-developable photosensitive material after or simultaneously with imagewise exposing, the heat-developable photosensitive material comprising a support having provided thereon a silver haline-containing photosensitive layer, a reducing agent, a basic precursor, a dye-providing substance which undergoes heat development to release or produce a dye, and a silver halide fixing agent which is a compound capable of fixing and stabilizing the silver halide, which process comprises the steps of isolating the silver halide fixing agent from the silver halide before heat-developing so as not to affect the silver halide and bringing the silver halide fixing agent in contact with the silver halide after or simultaneously with heat-developing to fix undeveloped silver halide, wherein the step of isolating the silver halide fixing agent from the silver halide is accomplished by (a) incorporating the silver halide fixing agent in the form of a solid dispersion into the heat-developable photosensitive material, (b) providing a water-resistant barrier layer between a layer containing the silver halide fixing agent and the photosensitive layer, or (c) incorporating the silver halide fixing agent into microcapsules and rupturing the microcapsules after or simultaneously with heat-developing to release the silver halide fixing agent contained in the inside of the microcapsules to diffuse the silver halide fixing agent into the photosensitive layer.

6. The image formation process of claim 5, wherein the silver halide fixing agent is slightly water-insoluble, and the isolation thereof is conducted by incorporating the silver halide fixing agent in the form of a solid dispersion into the heat-developable photosensitive material.

7. The image formation process of claim 5, wherein the isolation is conducted by providing a water-resistant barrier layer between a layer containing the silver halide fixing agent and the photosensitive layer.

8. The image formation process of claim 5, wherein the isolation is conducted by incorporating the silver halide fixing agent into microcapsules and the microcapsules are ruptured after or simultaneously with heat-developing to release the silver halide fixing agent contained in the inside of the microcapsules to diffuse the silver halide fixing agent into the photosensitive layer.

* * * * *